US008342789B2

(12) United States Patent
Yasuda et al.

(10) Patent No.: US 8,342,789 B2
(45) Date of Patent: Jan. 1, 2013

(54) LOADER WORK MACHINE

(75) Inventors: Toyoaki Yasuda, Osaka (JP); Masanori Fujino, Sakai (JP); Toshihiko Takemura, Izumi (JP); Yasuo Nakata, Sakai (JP); Yoshitaka Matsubara, Osaka (JP); Yoshihiro Ueda, Sakai (JP); Yuuki Takano, Sakai (JP); Yusuke Kawai, Sakai (JP); Ryohei Sumiyoshi, Sakai (JP); Hiroyuki Anami, Kaizuka (JP); Naoya Muramoto, Sakai (JP); Kenji Mitsui, Sakai (JP); Youhei Kawano, Sakai (JP); Takeshi Ikumura, Sakai (JP)

(73) Assignee: Kubota Corporation, Osaka (JP)

( * ) Notice: Subject to any disclaimer, the term of this patent is extended or adjusted under 35 U.S.C. 154(b) by 511 days.

(21) Appl. No.: 12/531,789

(22) PCT Filed: Mar. 25, 2009

(86) PCT No.: PCT/JP2009/055918

§ 371 (c)(1),
(2), (4) Date: Jan. 26, 2010

(87) PCT Pub. No.: WO2009/157236

PCT Pub. Date: Dec. 30, 2009

(65) Prior Publication Data

US 2010/0143086 A1 Jun. 10, 2010

(30) Foreign Application Priority Data

Jun. 26, 2008 (JP) ..... 2008-167356
Jul. 22, 2008 (JP) ..... 2008-188670
Sep. 3, 2008 (JP) ..... 2008-226305
Sep. 3, 2008 (JP) ..... 2008-226306
Sep. 3, 2008 (JP) ..... 2008-226307
Sep. 3, 2008 (JP) ..... 2008-226308
Sep. 3, 2008 (JP) ..... 2008-226309
Sep. 5, 2008 (JP) ..... 2008-228360
Sep. 12, 2008 (JP) ..... 2008-234103

(51) Int. Cl.
*E02F 3/00* (2006.01)

(52) U.S. Cl. ..... 414/686; 414/685; 296/190.05; 180/328; 180/69.21

(58) Field of Classification Search ..... 414/680, 414/685, 686; 296/190.01, 190.05; 180/328, 180/89.14, 69.2, 69.21
See application file for complete search history.

(56) References Cited

U.S. PATENT DOCUMENTS 5,547,244 A 8/1996 Lee
(Continued)

FOREIGN PATENT DOCUMENTS

EP 1 081 292 A1 3/2001
(Continued)

*Primary Examiner* — Donald Underwood
(74) *Attorney, Agent, or Firm* — The Webb Law Firm

(57) ABSTRACT

A hood for a loader work machine is provided at the rear end of the frame body and downwardly of the transverse connecting member between the pair of right/left support frame members. The transverse connecting member includes a front wall plate and an upper wall plate projecting rearward from an upper end of the front wall plate. The upper wall plate of the transverse connecting member is disposed more downwardly than the vertical center of the cabin. A rear portion of the upper wall plate is inclined downwardly rearward. A hood upper wall is provided for covering a rear upper side between the pair of right/left support frame members. A front end portion of the hood upper wall is connected to the rear portion of the upper wall plate of the transverse connecting member. The hood upper wall is inclined downwardly rearward in correspondence with the rear portion of the upper wall plate.

16 Claims, 23 Drawing Sheets

U.S. PATENT DOCUMENTS

| | | | |
|---|---|---|---|
| 6,098,739 | A | 8/2000 | Anderson et al. |
| 6,205,665 | B1 | 3/2001 | Anderson et al. |
| 6,616,398 | B2 | 9/2003 | Dershem et al. |
| 7,264,435 | B2 | 9/2007 | Layko et al. |
| 2007/0128012 | A1 | 6/2007 | Yamada et al. |

FOREIGN PATENT DOCUMENTS

| | | | |
|---|---|---|---|
| JP | 06-227440 | A | 8/1994 |
| JP | 3018819 | U | 9/1995 |
| JP | 2001-064990 | A | 3/2001 |
| JP | 2006-307498 | A | 11/2006 |
| JP | 2007-224567 | A | 9/2007 |

LOADER WORK MACHINE

TECHNICAL FIELD

The present invention relates to a loader work machine.

BACKGROUND ART

Conventionally, there is known a loader work machine as under (see Patent Document 1):—

A loader work machine comprising:

a pair of right/left arms disposed on right/left sides of a machine body frame, with base portions thereof being vertically pivotally supported to rear portions of the machine body for allowing leading ends of the pair of right/left arms to be lifted up/down on the forward side of the machine body frame;

a pair of right/left arm cylinders provided between the base portions of the arms and the rear portions of the machine body frame for lifting up/down the aims;

a cabin mounted on the machine body frame;

the machine body frame including a frame body having a bottom wall and a pair of right/left side walls, and a pair of right/left support frame members connected to a rear end of the frame body;

base portions of the pair of right/left arms being pivotally supported to the pair of right/left support frame members;

lower base end portions of a pair of right/left arm cylinders being pivotally connected to the pair of right/left support frame members; and a transverse connecting member disposed on a rear side of the cabin for interconnecting the pair of right/left support frame members in the right/left direction, a lower side of the transverse connecting member which is at the rear end of the frame body and between the pair of right/left support frame members constituting a hood for housing an engine.

With this type of conventional track loader, an upper wall plate of the transverse connecting member forming the upper wall of the hood is disposed more upwardly than the vertical center of the cabin.

Patent Document 1: U.S. Pat. No. 6,205,665B1

DISCLOSURE OF THE INVENTION

Conventionally, in the course of lifting up/down the arm, the first lift link projects significantly rearward from the rear end of the vehicle body of the loader work machine. Thus, there is high risk of the rear link hitting an object present rearwardly of the loader work machine during work, thus interfering with the work.

Conventionally, the upper wall plate of the transverse connecting member forming the upper wall of the hood is disposed more upwardly than the vertical center of the cabin, so that the position of the upper wall of the hood is high. For this reason, the rear visibility for the worker present inside the cabin was poor, so the work by the loader work machine would sometimes be difficult.

The present invention has been made in view of the above-described drawback and an object of the invention is to enable prevention of impairment of rear visibility by the hood during a work or the like, thus allowing a work by the loader work machine to be carried out smoothly.

The above object is fulfilled according to one aspect of the invention as under:—

A loader work machine comprising:

a machine body frame including a frame body having a bottom wall and a pair or right/left side walls, and a pair of right/left support frame members connected to a rear end of the frame body;

a cabin mounted on the machine body frame;

a transverse connecting member disposed rearwardly of the cabin for connecting the pair of right/left support frame members to right/left sides thereof, respectively;

a pair of right/left arms disposed on right/left sides of the machine body frame, with base portions thereof being vertically pivotally supported to the pair of right/left support frame members, respectively;

a pair of right/left arm cylinders provided between the base portions of the arms and the rear portions of the machine body frame for lifting up/down the arms: and a hood provided at the rear end of the frame body and downwardly of the transverse connecting member between the pair of right/left support frame members, for housing an engine;

wherein the transverse connecting member includes a front wall plate and an upper wall plate projecting rearward from an upper end of the front wall plate;

the upper wall plate of the transverse connecting member is disposed more downwardly than the vertical center of the cabin;

a rear portion of the upper wall plate is inclined downwardly rearward;

a hood upper wall is provided for covering a rear upper side between the pair of right/left support frame members;

a front end portion of the hood upper wall is connected to the rear portion of the upper wall plate of the transverse connecting member; and the hood upper wall is inclined downwardly rearward in correspondence with the rear portion of the upper wall plate.

According to a preferred further aspect of the loader work machine:— the cabin is pivotally supported to a support bracket projecting from the upper wall plate to be pivotable about a support shaft, the cabin being pivotable between a mounted state where a bottom portion of the cabin is mounted on the machine body frame and a collapsed state where the bottom portion of the cabin is upwardly away from the machine body frame;

the support shaft acting as a pivot for the cabin is disposed on a rear face side of the cabin and substantially at a vertical center of the cabin;

the hood is disposed more downward than the support shaft acting as the pivot for the cabin; and an upper face of the hood is disposed horizontal or downwardly inclined rearward so as not to project more upward than the support shaft.

According to a preferred further aspect of the loader work machine:— a height from a lower end of the machine body frame to a rear end of the hood upper wall is set to be ½ or less of a height from the lower end of the machine body frame to an upper end of the cabin.

According to a preferred further aspect of the loader work machine:— a lid member is provided at the rear end of the machine body frame for covering a rear end opening between the pair of right/left support frame members; and an upper end portion of the lid member is inclined downwardly rearward in correspondence with the hood upper wall.

According to a preferred further aspect of the loader work machine:—the upper wall plate of the transverse connecting member is disposed more upwardly than a seat portion of a driver's seat provided in the cabin and more downwardly than an upper end of a backrest of the driver's seat.

According to a preferred further aspect of the loader work machine:— the base portions of the pair of right/left arms are supported to a rear upper portion of the machine body frame via a rearward pair of right/left first lift links and a forward pair of right/left second lift links;

a front connecting member is provided at leading ends of the pair of right/left arms for interconnecting the pair of right/left arms; and a rear connecting member is provided at the base ends of the pair of right/left arms for interconnecting the pair of right/left arms; and wherein the pair of right/left arms, the front connecting member and the rear connecting member together form a rectangular framework.

According to a preferred further aspect of the loader work machine:— a lower base portion of the first lift link is pivotally supported to the machine body frame by a first lift support shaft;

a base portion of the second lift link is pivotally supported to the machine body frame by a second lift support shaft, forwardly of the first link support shaft;

a base portion of the arm is pivotally supported to an upper free end of the first lift link by a first arm support shaft;

a base portion of the arm is pivotally supported to a free end portion of the second lift link by a second arm support shaft, forwardly of the first arm support shaft;

a lower base end of the arm cylinder is pivotally connected to the machine body frame by a lower cylinder support shaft;

an upper leading end portion of the arm cylinder is pivotally connected to the base portion of the arm by an upper cylinder support shaft; and the rear connecting member is disposed forwardly of the first arm support shaft of the base portion of the arm.

According to a preferred further aspect of the loader work machine:— the rear connecting member is disposed on a connecting line interconnecting the first arm support shaft and the upper cylinder support shaft, at the base portions of the pair of right/left arms.

According to a preferred further aspect of the loader work machine:— the rear connecting member is disposed closer to the first arm support shaft than the upper cylinder support shaft.

According to a preferred further aspect of the loader work machine:— when the arm cylinder is contracted to lower the arm, the rear connecting member is located downwardly of the first arm support shaft; and when the arm cylinder is expanded to raise the arm, the rear connecting member is located upwardly of the first arm support shaft.

According to a preferred further aspect of the loader work machine:— the upper cylinder support shaft is disposed such that: when the arm cylinder is contracted to lower the arm, the upper cylinder support shaft is located downwardly of the rear connecting member; and when the arm cylinder is expanded to raise the arm, the upper cylinder support shaft is located upwardly of the rear connecting member.

According to a preferred further aspect of the loader work machine:— a holding member is provided for holding the hood upper wall under an opened posture; and the rear connecting member is disposed at a position upwardly away from the hood upper wall so that the hood upper wall can be held under the opened posture by the holding member when the arm cylinder is contracted to lower the arm.

According to a preferred further aspect of the loader work machine:— the base portion of the arm includes an outer wall and an inner wall;

an extension attaching wall extends from the inner wall at the base portion of the arm, and projects more downwardly than a lower edge of the outer wall;

an inner bracket is provided at a right/left inner side of the extension attaching wall and in opposition to the extension attaching wall;

an upper free end of the first lift link and an upper leading end of the arm cylinder are pivotally connected between the inner wall and the outer wall of the base portion of the arm; and a free end of the second lift link is pivotally connected between the extension attaching wall and the inner bracket.

According to a preferred further aspect of the loader work machine:— the second lift link is disposed on the inner side in the right/left direction than the arm cylinder so that the arm cylinder and the second lift link may cross each other as viewed sideways;

the upper free end of the first lift link is pivotally connected by the first arm support shaft, rearwardly of the extension attaching wall;

the upper leading end of the aim cylinder is pivotally connected to the upper cylinder support shaft, forwardly of the extension attaching wall; and the free end of the second lift link is pivotally connected by the second arm support shaft, more downwardly than a segment interconnecting the first arm support shaft and the upper cylinder support shaft.

According to a preferred further aspect of the loader work machine:— the base portion of the arm includes an upper connecting wall extending along upper edges of the inner wall and the outer wall, and a lower connecting wall extending along lower edges of the inner wall and the outer wall;

the inner wall and the outer wall of the base portion of the arm are interconnected by the upper connecting wall and the lower connecting wall;

the inner bracket is connected to an inner face of the extension attaching wall or an inner face of the inner wall, by a bracket connecting wall extending along an upper edge of the inner bracket; and an intermediate portion of the bracket connecting wall projects more upwardly than the lower connecting wall so that the bracket connecting wall may intersect the lower connecting wall as viewed sideways.

According to a preferred further aspect of the loader work machine:— a second arm support shaft provided on the free end side of the second lift link, and a second link support shaft are visible from outside the machine body frame.

According to the present invention, the upper wall plate of the transverse connecting member, whose lower portion constitutes a hood for housing an engine, is disposed more downwardly than the vertical center of the cabin. The rear portion of the upper wall plate is inclined downwardly rearward. The hood upper wall is provided for covering a rear upper side between the pair of right/left support frame members. The front end portion of the hood upper wall is connected to a rear portion of the upper wall plate of the transverse connecting member. And, the hood upper wall is inclined downwardly rearward in correspondence with the rear portion of the upper wall plate. With these, in comparison with the height of the entire cabin, the height of the entire hood disposed rearwardly of the cabin can be restricted or remain low, so that the hood hardly interferes with the rear view. Therefore, during a work, a worker can see, from inside the cabin, also the rear lower side of the hood, so that the work by the loader work machine can be effected more smoothly.

BEST MODE FOR CARRYING OUT THE INVENTION

Figure 1:
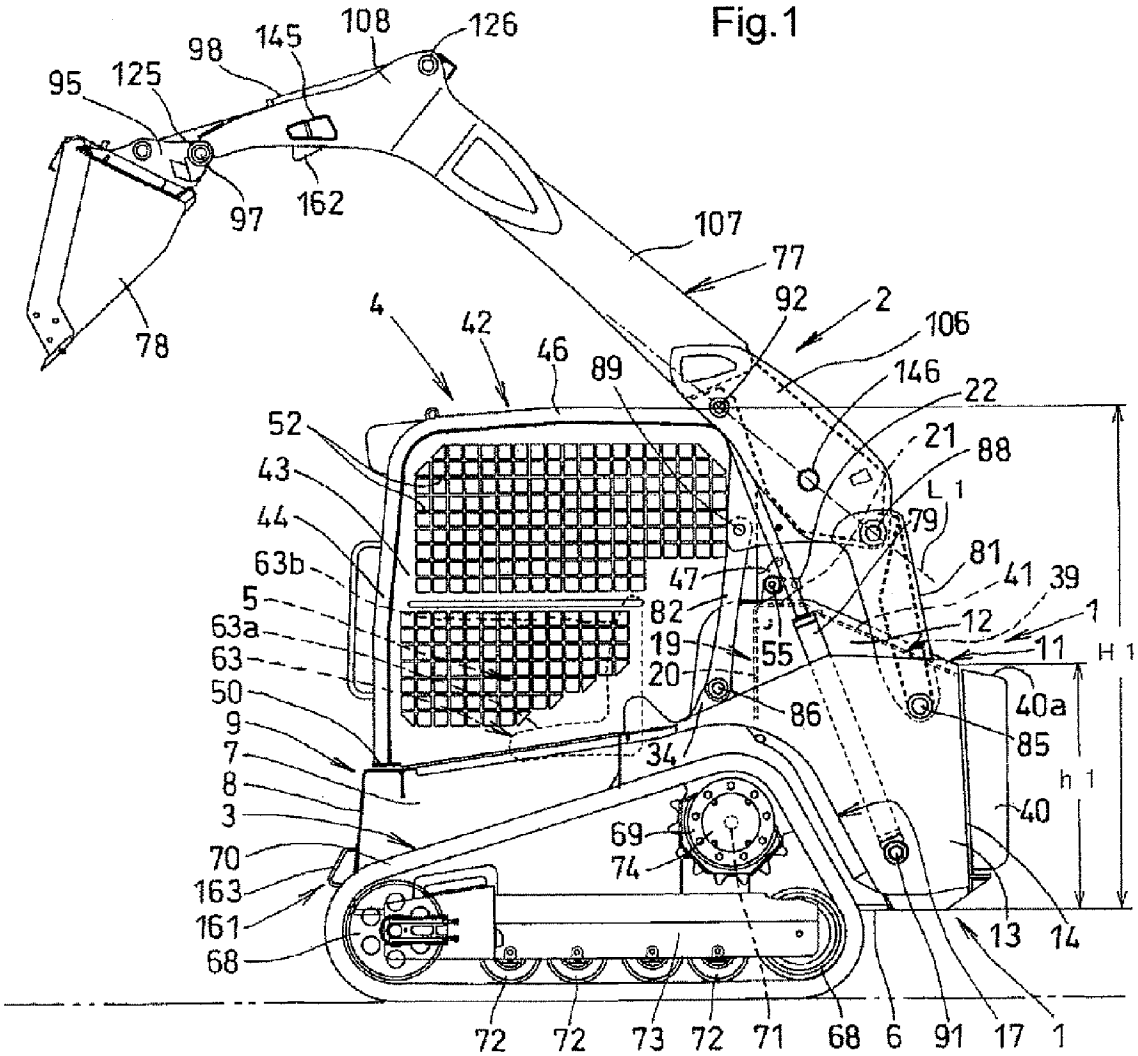
FIG. 1 is a side view showing an embodiment of the present invention, showing a loader work machine with arms 77 being lifted up.
Figure 2:
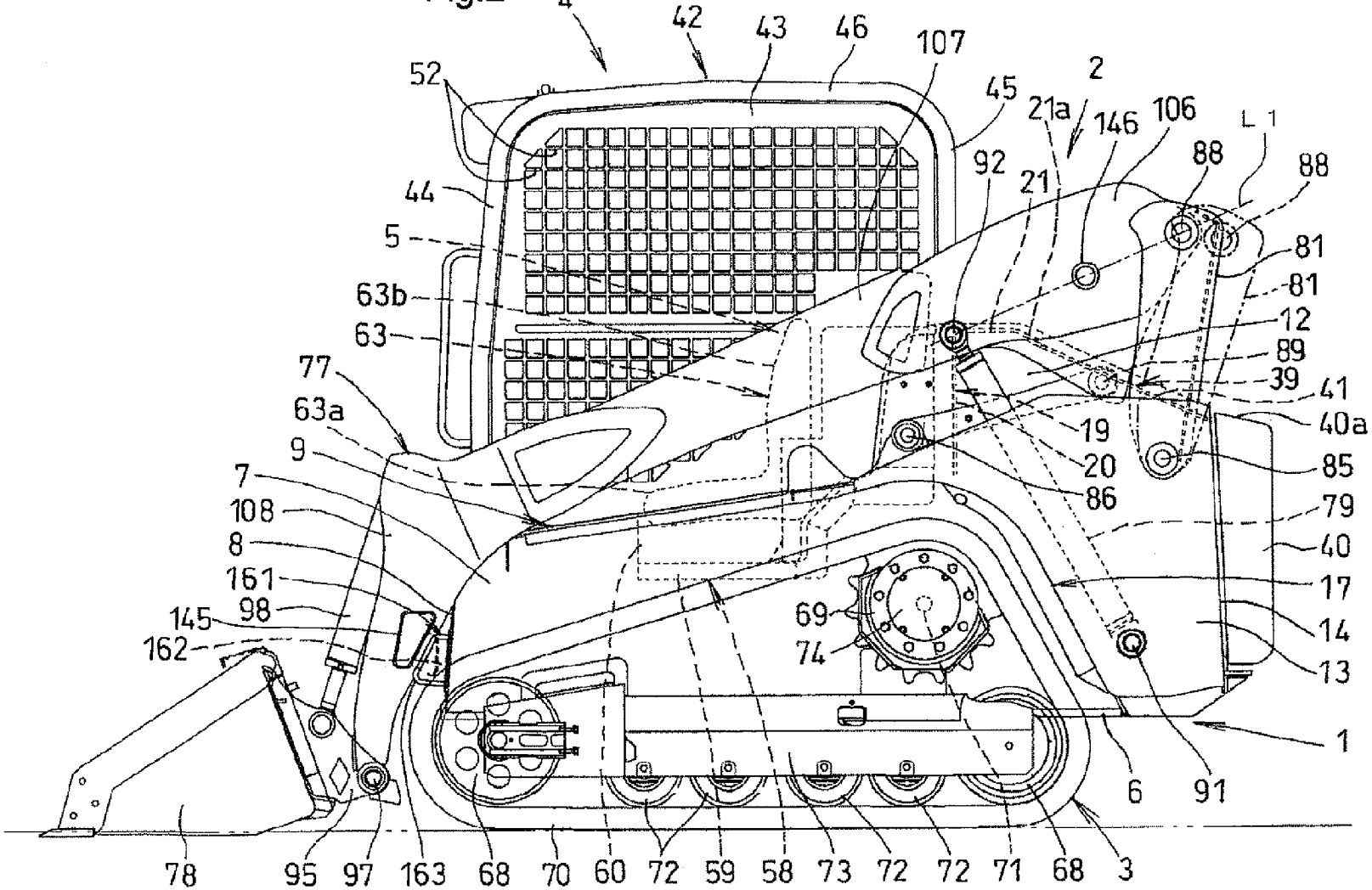
FIG. 2 is a side view of the loader work machine with the arms 77 being lowered.
Figure 3:
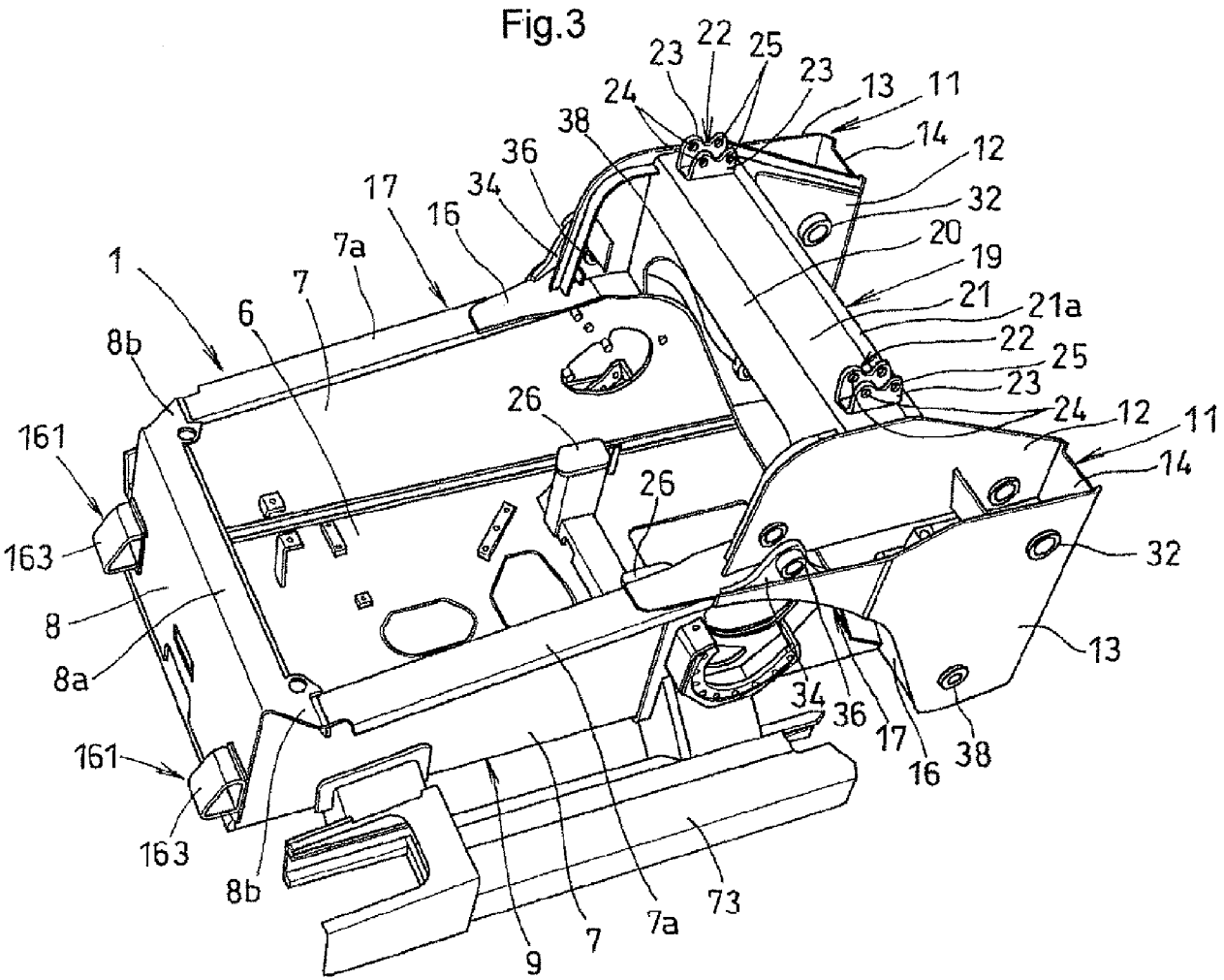
FIG. 3 is a perspective view showing a machine body frame as viewed from its front upper side.
Figure 4:
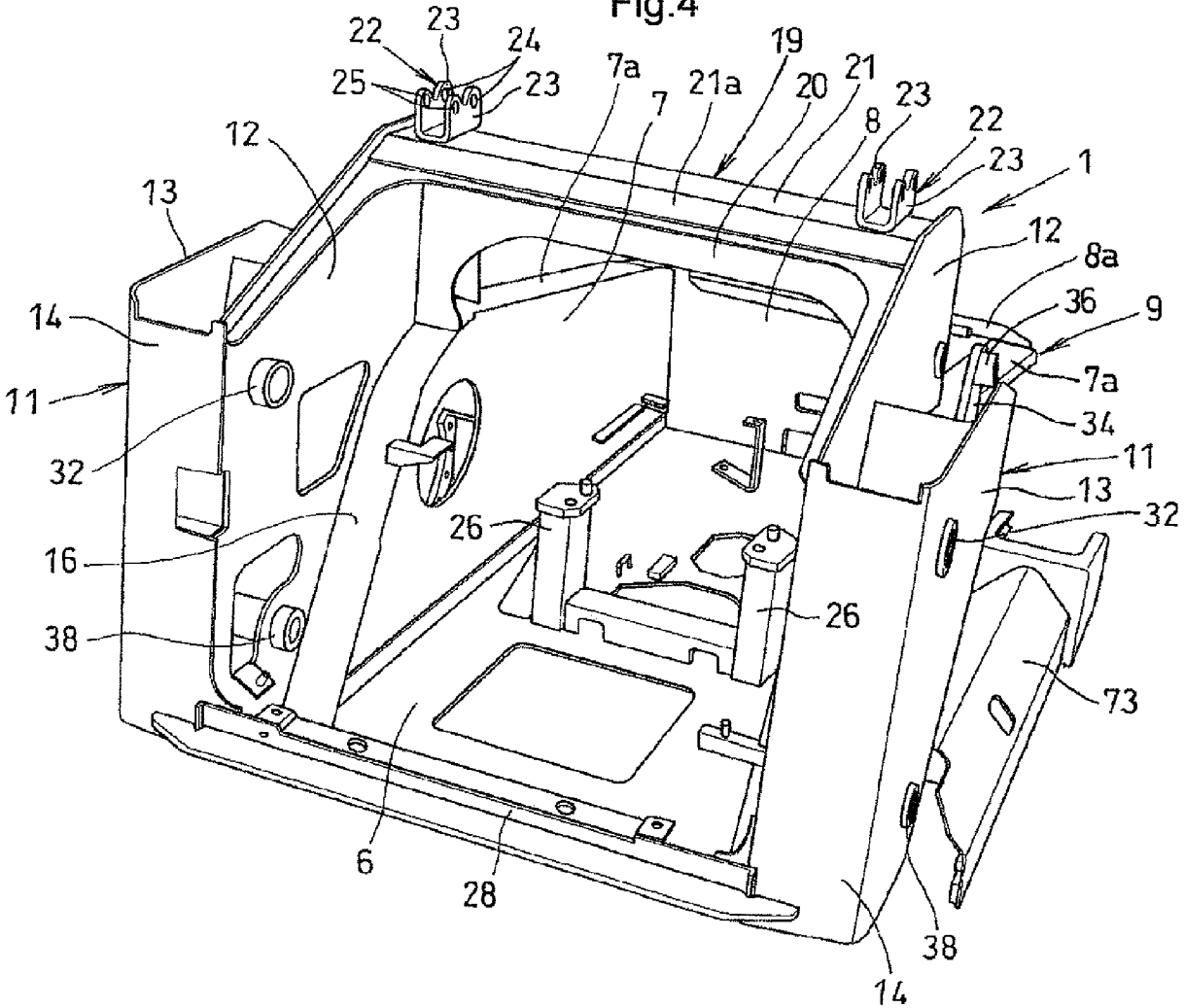
FIG. 4 is a perspective view showing the machine body frame as viewed from its rear side.
Figure 5:
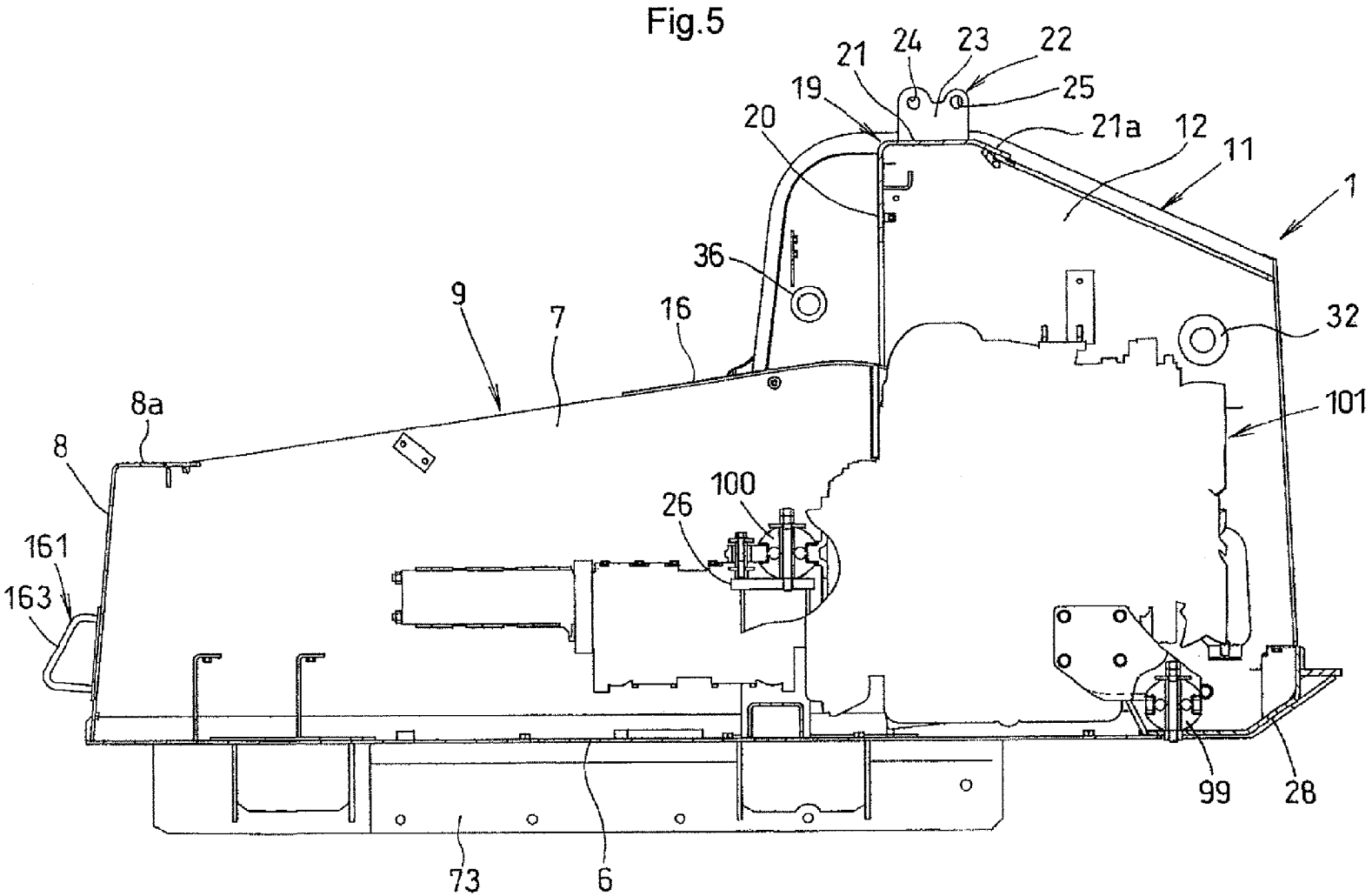
FIG. 5 is a side view in section showing the machine body frame portion.
Figure 6:
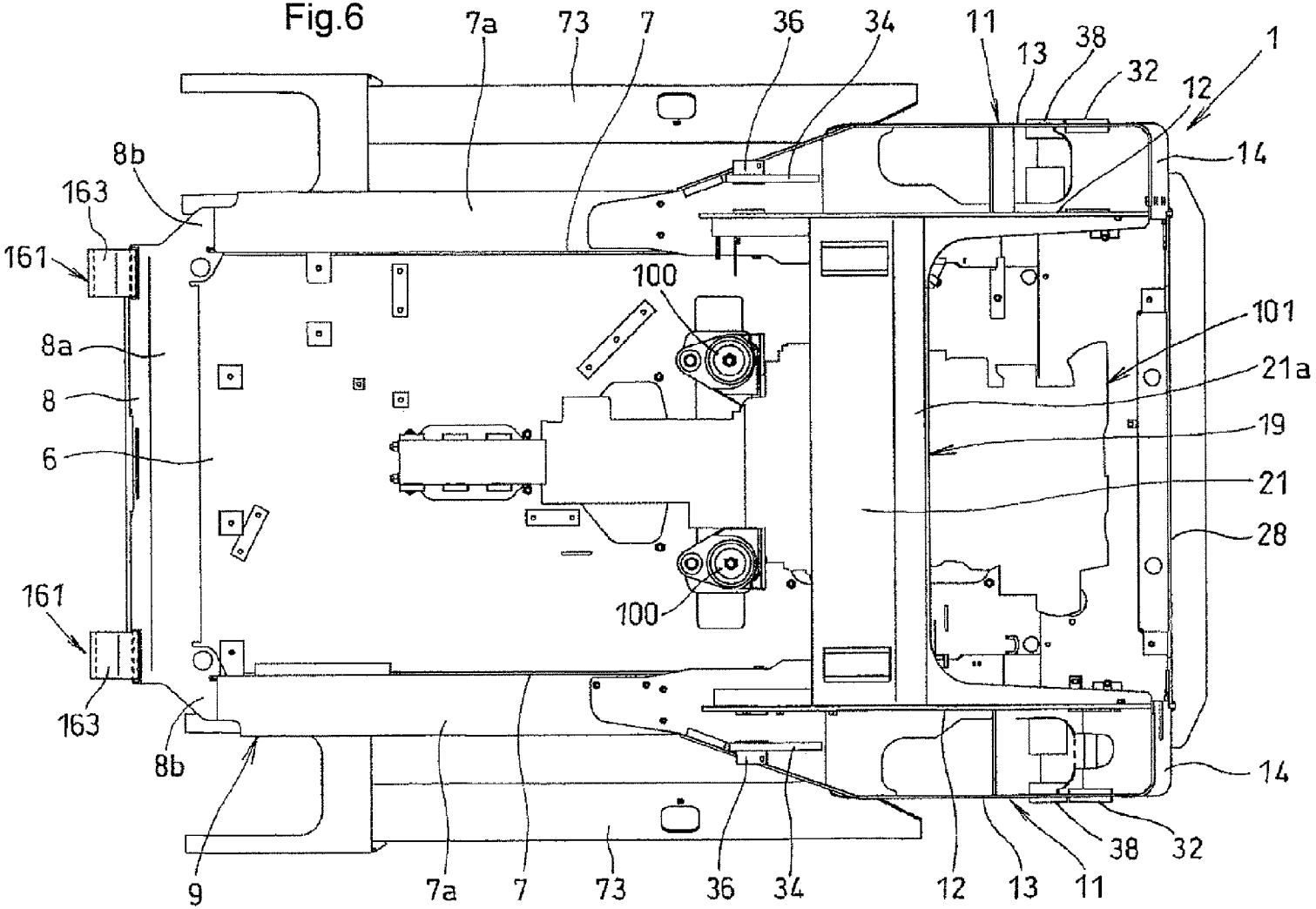
FIG. 6 is a plan view showing the machine body frame portion.
Figure 7:
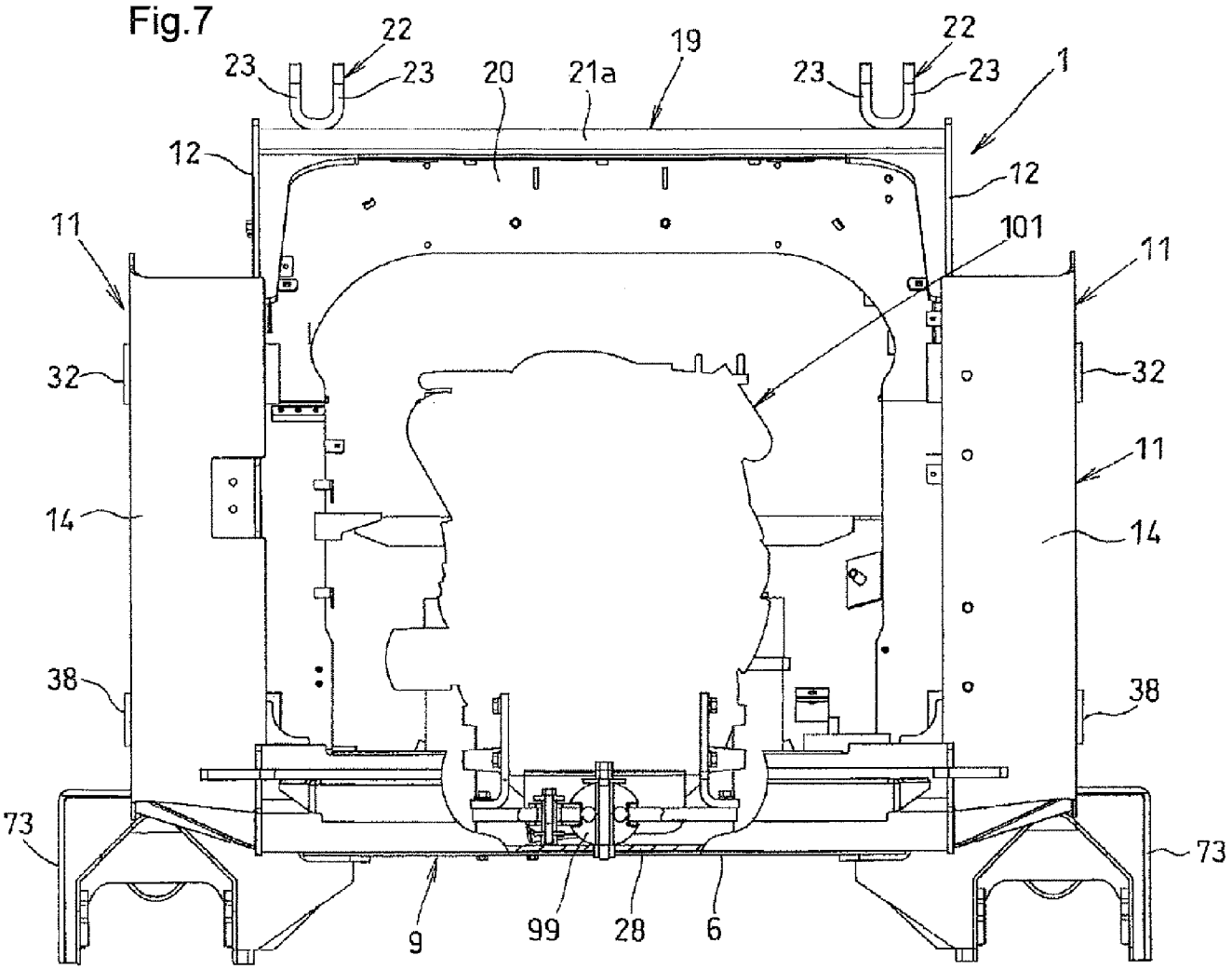
FIG. 7 is a rear view showing the machine body frame portion.

Next, embodiments of a loader work machine implementing the present invention will be described with reference to the accompanying drawings. In FIG. 1 and FIG. 2, a track loader as a loader work machine relating to the present invention includes a machine body frame 1, a loader implement (excavating implement) 2 mounted on the machine body frame 1, and a pair of right/left traveling devices 3 supporting the machine body frame 1. Upwardly of the machine body frame 1, there is provided a driving section 5 having a driver's seat 63 to be described later, a steering lever, etc. On a front portion of the machine body frame 1, there is mounted a cabin (driver protecting device) 4 surrounding the driving section 5.

In FIGS. 3-7, the machine body frame 1 formed of iron plates etc. includes a frame body 9 and a pair of right support frame members 11. The pair of right/left support frame members 11 are connected to each other at the rear ends thereof by means of welding. The frame body 9 is formed like a top-opened box-like unit having a bottom wall 6, a pair of right/left side walls 7 and a front wall 8. The upper edge of the rear end of each one of the pair of right/left side walls 7 is formed arcuate with a rear downward inclination, with the edge extending progressively downward. At the upper end of each one of the pair of right/left side walls 7, there is provided a bent edge portion 7*a* projecting outward in the right/left direction. At the upper end of the front wall 8, there is provided a bent edge portion 8*a* and from the right/left opposed sides of the bent edge portion 8*a*, connecting pieces 8*b* extend rearward respectively, with each connecting piece 8*b* welded to the front end of each one of the pair of right/left bent edge portions 7*a*.

The pair of right/left support frame members 11 each has an inner wall 12, an outer wall 13, and a connecting wall 14 interconnecting the rear end of the inner wall 12 and the rear end of the outer wall 13, and the frame member 11 has an angular letter C-like shape.

At a rear end portion of the side wall 7, there is disposed and fixed by welding, an arcuate-curved attaching plate 16, with its inner side intersecting the side wall 7 in the form of letter-T or letter-L shape. The rear end of the bent edge portion 7*a* is fixed to and superposed on the front end portion of the attaching plate 16 by means of welding. An outer side of the attaching plate 16 projects laterally outwardly from an upper end of the side wall 7. The bent edge portion 7*a* and the attaching plate 16 together constitute a fender 17 which covers the upper side and the rear side of the traveling device 3.

The inner walls 12 and the outer walls 13 of the pair of right/left support frame members 11 are disposed on the outer sides of the side walls 7 of the frame body 9, and front lower ends of the inner wall 12 and the outer wall 13 are fixed by welding to the upper face of the outer portion of the attaching plate 16. As described above, the pair of right/left support frame members 11 are fixedly connected via the attaching plate 16 to the respective side walls 7 of the machine body frame 1. Respective upper portions of the inner wall 12, the outer wall 13 and the connecting wall 14 of the support frame member 11 project more upwardly than the side walls 7.

The upper portions of the inner walls 12 of the pair of right/left support frame members 11 are interconnected with a transverse connecting member 19. This transverse connecting member 19 includes a portal-shaped front wall plate 20, and an upper wall plate 21 that projects rearward from the upper end of the front wall plate 20. A rear portion 21*a* of the upper wall plate 21 is formed with a downwardly rearward inclination. From the right/left opposed ends of the upper wall plate 21, a pair of right/left U-shaped support brackets 22 project upward. Each one of the pair of right/left support brackets 22 includes a pair of right/left support plate portions 23, each support plate portion 23 defining a front side attaching hole 24 and a rear side retaining hole 25 extending therethrough in the right/left direction.

At rear side intermediate portions of the bottom plate 6 of the frame body 9, there are provided a pair of support decks 26 projecting upward. At the rear end of the frame body 9 and along the rear end of the bottom wall 6, there is provided a lower connecting member 28. This lower connecting member 28 is fixedly welded to the pair of right/left support frame members 11 and fixedly welded to the rear end portion of the bottom wall 6 of the machine body frame 1. That is to say, the lower ends of the pair of right/left support frame members 11 are interconnected via the lower connecting member 28. The lower connecting member 28 is fixedly welded and connected to the bottom wall 6 of the machine body frame 1 and opposed ends of the lower connecting member 28 are fixedly welded to the inner wall 12 or the connecting wall 14 of the pair of right/left support frame members 11, respectively, and the pair of right/left support frame members 11 are connected via the lower connecting member 28 to the bottom wall 6.

At a rear upper end each of the right/left support frame members 11 and between the inner wall 12 and the outer wall 13, there is provided a first attaching boss 32 having an attaching hole. At the upper front end portion of the outer walls 13 of the support frame member 11, a stay member 34 projects upwardly rearward. The front end portion and the lower end of the stay member 34 are fixedly attached by means of e.g. welding, to the outer wall 13 and to the attaching plate 16. Between the stay member 34 and the inner wall 12, there is provided a second attaching boss 36 having an attaching hole. At a lower end of the support frame member 11 and between the inner wall 12 and the outer wall 13, there is provided a third attaching boss 38 having an attaching hole.

As shown in FIGS. 5 through 8, the engine 101 is mounted on the rear side of the bottom wall 6 of the machine body frame 1. The right/left center portion of the rear end of the engine 101 is fixedly mounted on the lower connecting member 28 via a vibration damping member 99, and the right/left sides of the front end portion of the engine 101 are fixedly mounted on the pair of right/left support decks 26 via vibration damping members 100.

In FIGS. 1-7, the transverse connecting member 19 is provided on the rear side of the cabin 4, and the lower side of the transverse connecting member 19 at the rear end of the frame body 9 and between the pair of right/left support frame members 19 comprises an engine room for housing the engine 101. A hood 39 covering the engine room is provided at the rear end portion of the machine body frame 1 and includes an upper hood wall 41 and a lid member 40.

The upper wall plate 21 of the transverse connecting member 19 is disposed downwardly of the vertical center of the cabin 4 and the rear portion 21*a* of the upper wall plate 21 is inclined downward rearwardly. Rearwardly of the upper wall member 21, the upper hood wall 41 is provided in such a manner as to cover the rear upper sides of the pair of right/left support frame members 11. The front end portion of the hood upper wall 41 is connected to the rear portion 21*a* of the upper wall plate 21 of the transverse connecting member 19. The hood upper wall 41 is formed with a rearwardly downward inclination in correspondence with the rear portion 21*a* of the upper wall plate 21. As shown in FIG. 1, a height h1 from the lower end of the machine body frame 1 to the rear end of the hood upper wall 41 is set to be equal to or less than ½ of a height H1 from the lower end of the machine body frame 1 to the upper end of the cabin 4.

Figure 12:
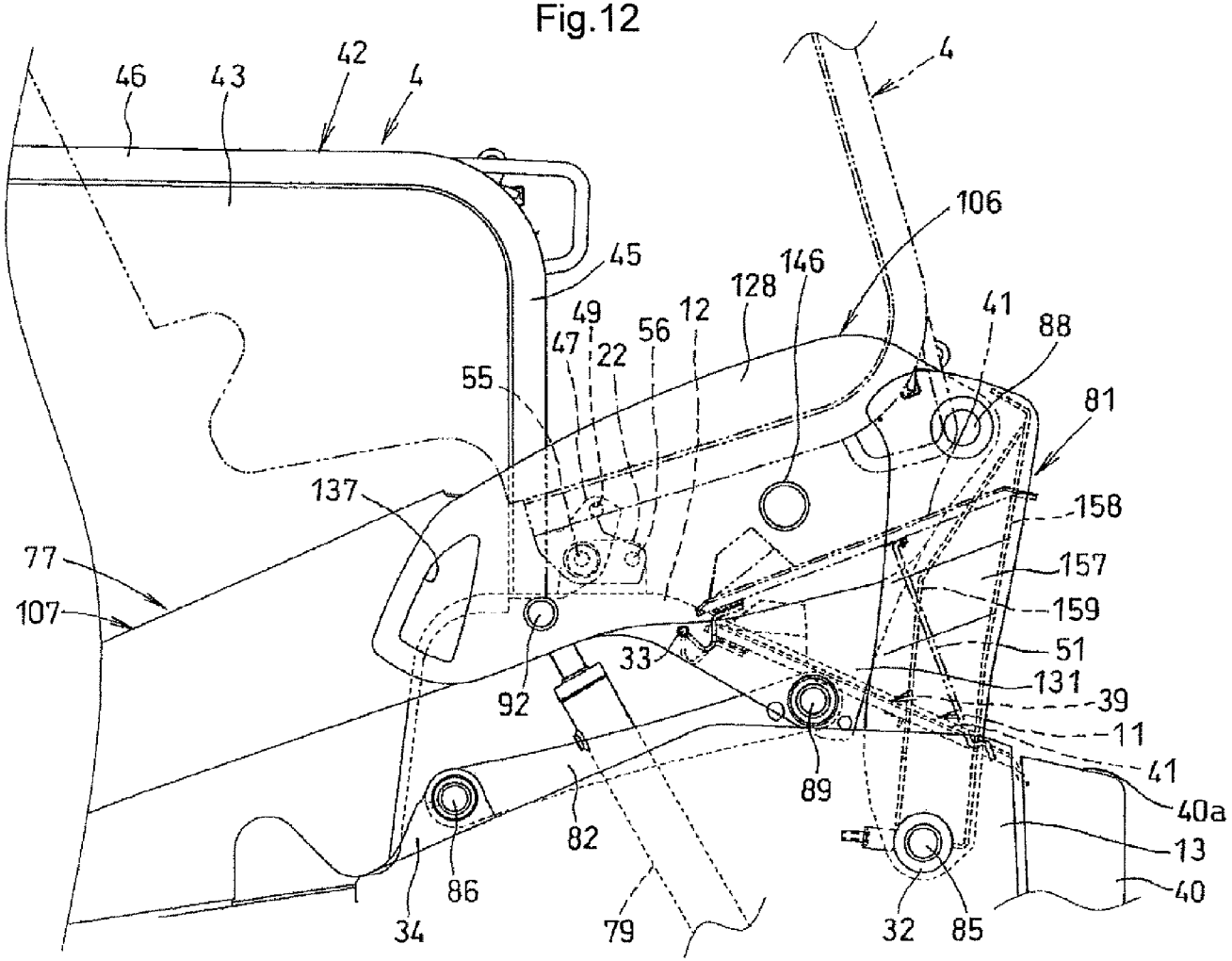
FIG. 12 is a side view showing a hood upper portion and a rear portion of the arm.

As shown in FIG. 12, the hood upper wall 41 covering the upper side of the hood 39 has its front end portion supported to be vertically pivotable about a support shaft 33 oriented along the right/left direction. The hood upper wall 41 can be opened/closed between a closing posture for covering the upper side of the engine room (see the broken line in FIG. 12) and an opened posture where the hood upper wall 41 is inclined upwardly rearward for opening up the upper side of the engine room (see the chain line in FIG. 12). Inside the hood 39, there is provided a holding member 51 for holding the hood upper wall 41 under the opened posture. The lid member 40 for covering the rear end opening between the pair of right/left support frame members 11 is provided to be openable and closable, and the upper wall portion 40*a* of the lid member 40 is inclined downwardly rearward in correspondence with the hood upper wall 41.

As shown in FIG. 1, FIG. 2 and FIG. 12, the cabin 4 acting as a driver protecting unit includes a pair of right/left side frame members 42, a roof member mounted and supported between the upper portions of the side frame members 42, and a pair of right/left side wall members 43 attached respectively to the right/left side frame members 42. The pair of right/left side frame members 42 are formed of e.g. pipes or the like and include a pair of right/left front post portions 44, a pair of right/left rear post portions 45 and a pair of right/left upper transverse beam portions 46 interconnecting the upper end of the corresponding front post portion 44 and the upper end of the corresponding rear post portion 45. A pair of right/left attaching brackets 47 project rearward from the lower ends of the right/left rear post portions 45. The right/left attaching brackets 47 correspond to the respective support brackets 22 of the machine body frame 1, each including an attaching hole and a retaining hole 49 in correspondence with the attaching hole 24 and the retaining hole 25 of the associated support bracket 22, respectively. A mounting plate 50 is fixedly attached by means of e.g. welding to the lower ends of the right/left front post portions 44.

The pair of side wall members 43 are formed each of e.g. a metal plate, and are fixedly attached by means of welding or the like to the pair of side frame members 42, respectively. Each side wall member 43 defines a number of open holes 52 for allowing viewing the outer lateral side from inside the cabin 4, so that the operator can see, through these open holes 52, the arms 77 and/or the loader implement 2 located on the laterally outer sides.

A support shaft 55 oriented along the right/left direction is inserted into and supported by the attaching hole 24 of each support bracket 22 and the attaching hole of the attaching bracket 47. The cabin 4 is supported via the attaching bracket 47 to the support bracket 22 of the machine body frame 1 to be pivotable about the support shaft 55. With this, the cabin 4 can be switched over in its posture between a mounted state in which the cabin is mounted on the machine body frame 1, with the bottom side thereof closing the upper opening of the machine body frame 1; and a collapsed state in which the bottom side of the cabin 4 is moved upwardly away from the machine body frame 1 to open up the upper opening of the machine body frame 1. As shown by the solid line in FIG. 12, when the cabin 4 is pivoted forwardly about the support shaft 55, the mounting plate 50 comes into contact with and is supported to the upper edge 8*a* of the front wall 8 via a shock absorbing member, whereby the cabin 4 can be maintained under the mounted state. Further, as shown by the chain line in FIG. 12, when the cabin 4 is pivoted rearwardly about the support shaft 55, thus being collapsed, the retaining holes 49 of the pair of attaching brackets 47 come into registry with the retaining holes 25 of the pair of support brackets 22. Then, by inserting retaining pins 56 through the retaining holes 25 and the retaining holes 49, the cabin 4 can be maintained under the forwardly pivoted collapsed state. In this way, the cabin 4 is pivotally supported to the machine body frame 1.

Incidentally, when the cabin 4 is rendered into the mounted state, traveling of the track loader and/or a work by the loader implement 2 are/is effected. When the cabin 4 is rendered into the collapsed state, e.g. a maintenance operation inside the machine body frame 1 is effected.

The support shaft 55 serving as the pivot for the cabin 4 is disposed on the rear face side of the cabin 4 and at the vertical center of the cabin 4. Further, the hood 39 is disposed downwardly of the support shaft 55 acting as the pivot for the cabin 4 and the upper face of the hood 39 (an upper face of the upper wall plate 21 and an upper face of the hood upper wall 41) is disposed horizontally or downwardly inclined rearward so as not to project more upward than the support shaft 55.

As shown in FIG. 2, at the front/rear center portion at the lower ends of the fight/left side wall members 43, the bottom wall member 58 is fixedly connected by means of e.g. welding. The bottom wall member 58 is formed of e.g. a metal plate and includes a bottom wall portion 59 and a pair of right/left side wall portions 60 and is formed as an angular-C shaped component. On the upper face of the bottom wall portion 59 via a cushioning member, there is provided the driver's seat 63. The upper wall plate 21 of the transverse connecting member 19 is disposed upwardly of the seat portion 63*a* of the driver's seat 63 provided inside the cabin 4 and downwardly of the upper end of a backrest portion 63*b* of the driver's seat 63.

As described above, the cabin 4 has its upper side covered with the roof, has its lateral sides covered with the pair of side wall members 43, has its rear side covered with a rear glass sheet or the like and further has its lower front/rear center portion covered with the bottom wall member 58, so that the cabin 4 is formed like a front-side opened box.

In FIG. 1 and FIG. 2, each one of the pair of right/left traveling devices 3 includes a pair of front and rear driven wheels 68, a drive wheel 69 disposed upwardly between the pair of driven wheels 68, and a track frame 73. The track frames 73 of the pair of right/left traveling devices 3 are attached integrally by means of welding to the pair of right/left side walls 7 of the frame body 9, respectively. The pair of right/left traveling devices 3 each comprises a crawler traveling device with a crawler 70 being entrained around the driven wheels 68 and the drive wheel 69. The traveling device 3 effects driving with rotation of the drive wheel 69 about a drive shaft 71 in association of rotation of this drive shaft 71. The pair of driven wheels 68 are freely rotatably supported to front and rear opposed ends of the track frame 73 to be rotatable about a transverse shaft, respectively. One of the pair of driven wheels 68 is urged in a tension adjusting direction by means of an unillustrated tension adjusting mechanism. Between the pair of driven wheels 68, a plurality of free wheels 72 are provided and each one of these free wheels 72 is supported to the track frame 73 to be freely rotatable about a transverse shaft. The drive shaft 71 of the traveling device 3 is disposed downwardly of the rear end of the cabin 4.

Each one of the pair of right/left traveling devices 3 includes a hydraulic traveling motor 74 of its own, so that the traveling motor 74 rotatably drives the drive shaft 71, and rotation of the drive shaft 71 drives the drive wheel 69 about the drive shaft 71 via rotation of the drum of the traveling motor 74. With this, each traveling device 3 is driven by each traveling motor 74.

The loader implement 2 includes a pair of right/left arms 77 and a bucket (implement) 78 attached to the leading ends of the arms 77. The pair of right/left arms 77 are supported to rear upper portions of the machine body frame 1, with base portions of the arms 77 being vertically pivotable via first lift links 81 on the rear side and second lift links 82 on the front side, so that the leading ends of the arms 77 are lifted up/down on the front side of the machine body frame 1. Between the base portions of the pair of right/left arms 77 and the rear lower portion of the machine body frame 1, there are provided a pair of right/left arm cylinders 79 comprised of double-acting cylinders.

The lower base portion of the first lift link 81 is inserted between the inner wall 12 and the outer wall 13 corresponding to the first attaching boss 32 of the machine body frame 1, and as a first link support shaft 85 is inserted into the attaching hole of the first attaching boss 32 and inserted through the lower base portion of the first lift ink 81, the lower base portion of the first lift link 81 is supported to the machine body frame 1 (first attaching boss 32) to be pivotable in the front/rear direction about the first link support shaft 85.

The front base portion of the second lift link 82 is inserted between the stay member 34 and the inner wall 12 corresponding to the second attaching boss 36 of the machine body frame 1, and as a second link support shaft 86 is inserted into the attaching hole of the second attaching boss 36 and inserted through the front base portion of the second lift link 82, the front base portion of the second lift link 82 is supported to the machine body frame 1 (second attaching boss 36) to be pivotable up/down about the second lift support shaft 85, forwardly of first link support shaft 85.

The lower base portion of the arm cylinder 97 is inserted between the inner wall 12 and the outer wall 13 corresponding to the third attaching boss 38 of the machine body frame 1, and as the lower cylinder support shaft 91 is inserted into the attaching hole of the third attaching boss 38 and inserted through the lower base end of the arm cylinder 79, the lower base portion of the arm cylinder 97 is connected to the machine body frame 1 to be pivotable about the lower cylinder support shaft 91.

Figure 9:
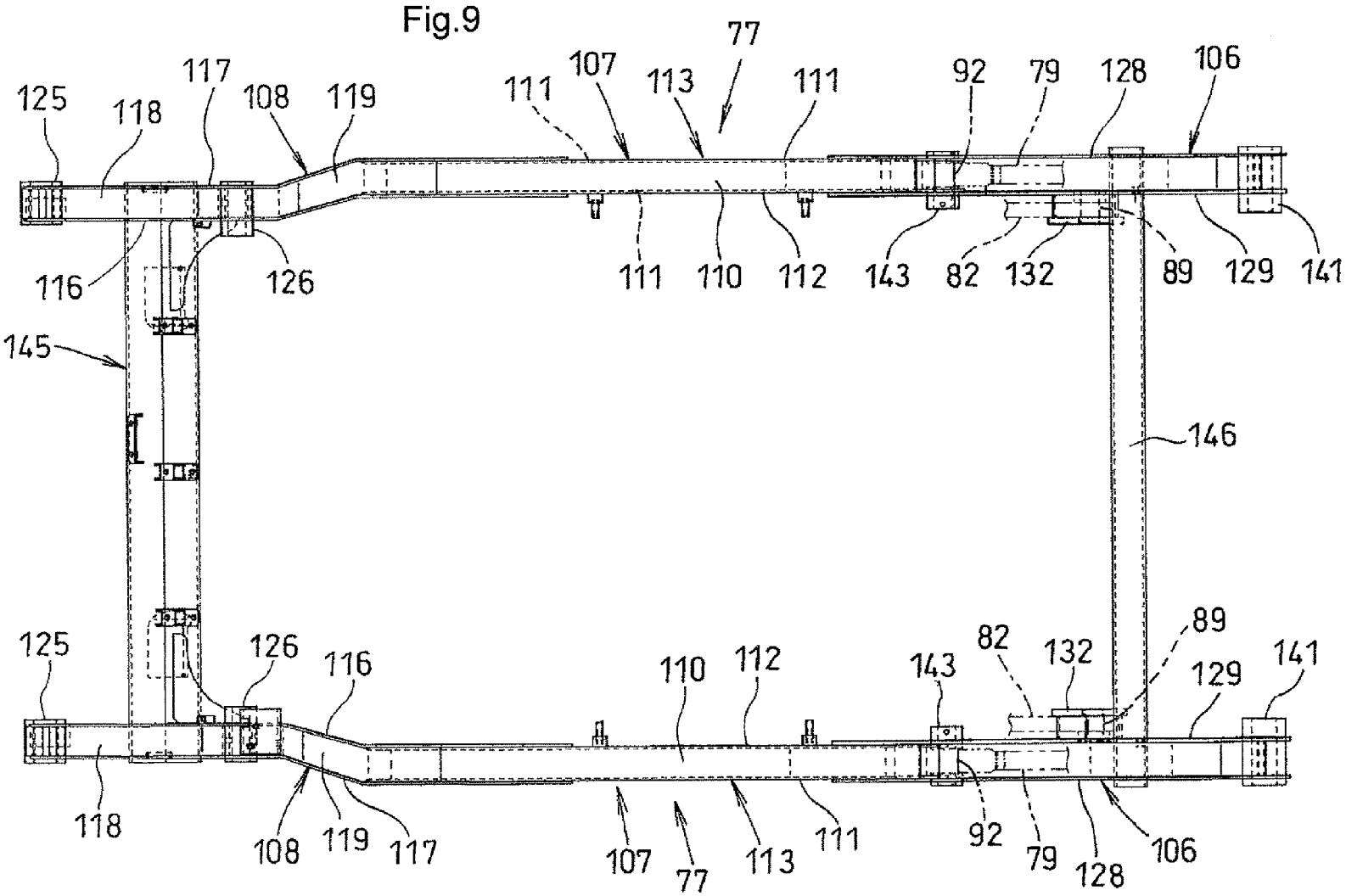
FIG. 9 is a plan view of the arms.
Figure 10:
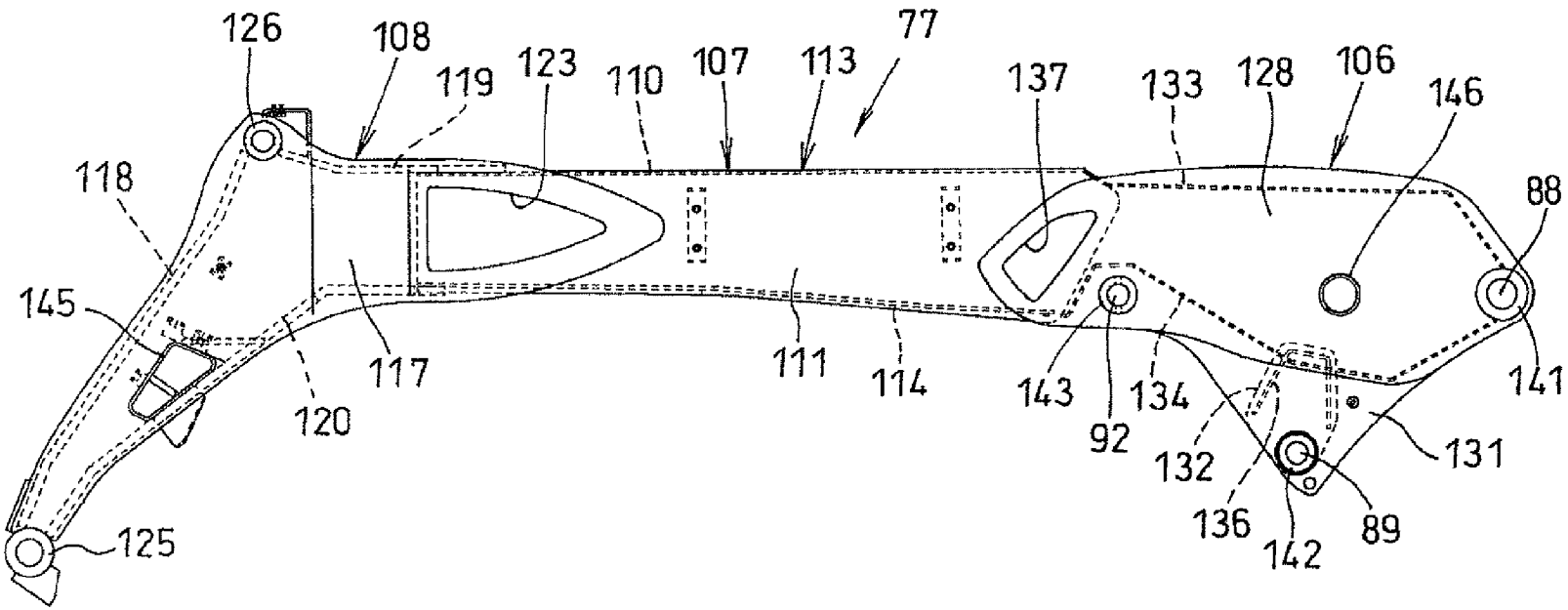
FIG. 10 is a side view of the arm.

In FIGS. 9 and 10, each one of the pair of right/left arms 77 includes, along its longitudinal direction, a base member 106, an intermediate member 107 and a leading end member 108. The intermediate member 107 includes an intermediate member main body 113 which includes a top wall 110, an outer wall 111 and inner wall 112 arranged in the layout of an one-side open rectangular shape; and a bottom wall plate 114 which interconnects the lower end of the outer wall 111 and the lower end of the inner wall 112 of the intermediate member main body 113. The intermediate member main body 113 and the bottom wall plate 114 are provided separately of each other. The bottom wall member 114 is fixedly attached by welding to the lower end of the outer wall 111 and the lower end of the inner wall 112.

The leading end member 108 of the arm 77 includes an inner wall 116 and an outer wall 117. The leading end member 108 further includes a front connecting wall 118 interconnecting the inner wall 116 and the outer wall 117, an upper connecting wall 119 and a lower connecting wall 120. The front connecting wall 118, the upper connecting wall 119 and the lower connecting wall 120 are fixedly attached by welding to the inner wall 116 and the outer wall 117.

The rear end portion of the leading end member 108 is engaged on and welded to the front end portion of the intermediate member 107. The rear end portion of the inner wall 116 and the rear end portion of the outer wall 117 are disposed so as to bind therebetween in the right/left direction the front end portion of the intermediate member 107. The opened edge portions of welding holes 123 of the inner wall 116 and the outer wall 117 are welded to the inner wall and the outer wall of the intermediate member 107. The rear end portion of the upper connecting wall 119 and the rear end portion of the lower connecting wall 120 are disposed so as to bind vertically therebetween the front end portion of the intermediate member 107. And, the rear edge portion of the upper connecting wall 119 and the rear edge portion of the lower connecting wall 120 are welded respectively to the top wall 110 and the bottom wall plate 114 of the intermediate member 107.

At the leading end of the leading end member 108 of the arm 77, there is provided a cylindrical, leading end connecting boss 125. At an upper intermediate portion of the leading end member 108, there is provided a cylindrical, upper connecting boss 126. The base member 106 of the arm (the base of the arm 77) includes an outer wall 128 and an inner wall 129. As an extension of the inner wall 129, there is provided a triangular extension attaching wall 131 which projects downward from the lower edge of the outer wall 128. At the right/left inner side of the extension attaching wall 131, there is provided an inner bracket 132 in opposition to the extension attaching wall 131.

The base member 106 of the arm 77 includes an upper connecting wall 133 extending along the upper edge portions of the inner wall 129 and the outer wall 128 and a lower connecting wall 134 extending along the lower edge portions of the inner wall 129 and the outer wall 128. The inner wall 129 and the outer wall 128 are connected to each other via the upper connecting wall 133 and the lower connecting wall 134. A bracket connecting wall 136 is extending along the upper edge portion of the inner bracket 132. The inner bracket 132 is connected, via the bracket connecting wall 136, to the inner face of the extension attaching wall 131 or the inner face of the inner wall 129. An intermediate portion of the bracket connecting wall 136 projects upwards relative to the lower connecting wall 134 such that the bracket connecting wall 136 intersects the lower connecting wall 134 as viewed laterally.

The front end portion of the base member 106 of the arm 77 is engaged on and welded to the rear end portion of the intermediate member 107. That is, the front end portion of the inner wall 129 and the front end portion of the outer wall 128 of the base member 106 are disposed so as to bind therebetween in the right/left direction the rear end portion of the intermediate member 107. The opened edge portions of welding holes 137 of the inner wall 129 and the outer wall 128 are welded respectively to the inner wall 112 and the outer wall 111 of the intermediate member 107. The front end portion of the upper connecting wall 133 and the front end portion of the lower connecting wall 134 of the base member 106 are disposed so as to vertically bind therebetween the rear end portion of the intermediate member 107. The front edge portion of the upper connecting wall 133 and the front edge portion of the lower connecting wall 134 are respectively welded to the top wall 110 and the bottom wall plate 114 of the intermediate member 107.

At the rear end portion of the base member 106 of the arm 77 and between the inner wall 129 and the outer wall 128, there is provided a first connecting boss 141 having an attaching hole. Between the extension attaching wall 131 and the inner bracket 132, there is provided a second connecting boss 142 having an attaching hole. Forwardly of the first connecting boss 141 and the extension attaching wall 131 and between the inner wall 129 and the outer wall 128, there is provided a third connecting boss 143 having an attaching hole. The rear end of the upper connecting wall 133 and the rear end of the lower connecting wall 134 are connected to the first connecting boss 141. An intermediate portion of the lower connecting wall 134 is disposed upwardly and clear of the third connecting boss 143.

A first arm support shaft 88 is inserted into and held in the first connecting boss 141 via its attaching hole. A second arm support shaft 89 is inserted into and held in the second connecting boss 142 via its attaching hole. An upper cylinder support shaft 92 is inserted into and held in the third connecting boss 143 via its attaching hole.

As shown in FIG. 9 and FIG. 10, the leading end portions of the fight/left arms 77 are connected to each other via the front connecting member 145, and the base portions of the right/left arms 77 are connected to each other via a rear connecting member 146. The front connecting member 145 is formed of a pipe member in the form of an angular cylinder. The front connecting member 145 is inserted into the leading ends of the right/left arms 77 (the inner wall 116 and the outer wall 117 of the leading end member 108) and welded to the arms 77. The rear connecting member 146 is formed of a cylindrical pipe member. The rear connecting member 146 is inserted into the base end portions of the right/left arms 77 (the inner wall 129 and the outer wall 128 of the base member 106) and welded to the respective arms 77. The front connecting member 145 and the rear connecting member 146 interconnect the pair of right/left arms 77 in the right/left direction forwardly and rearwardly of the cabin 4, and the pair of right/left rams 77, the front connecting member 146 and the rear connecting member 146 together constitute a rectangular framework.

As shown in FIG. 1, FIG. 2 and FIGS. 9-12, the upper free end of the first lift link 81 and the upper leading end of the arm cylinder 79 are pivotally connected respectively between the inner wall 129 and the outer wall 128 of the base portion of the arm 77. The free end of the second lift link 82 is pivotally connected between the extension attaching wall 131 and the inner bracket 132. That is, the upper free end of the first lift link 81 is pivotally connected by the first arm support shaft 88, rearwardly of the extension attaching wall 131; and the upper leading end of the arm cylinder 79 is pivotally connected by the upper cylinder support shaft 92, forwardly of the extension attaching wall 131. The free end of the second lift cylinder 82 is pivotally connected by the second arm support shaft 89, downwardly of a connecting line L1 interconnecting the first arm support shaft 88 an the upper cylinder support shaft 92.

Therefore, the base portion of the arm 77 is pivoted by the first arm support shaft 88 to the upper free end of the first lift link 81 and the base portion of the arm 77 is supported to be vertically pivotable about the first arm support shaft 88. The base portion of the arm 77 is pivoted by the second arm support shaft 88 to the free end of the second lift link 82, forwardly of the first arm support shaft 88; and the base portion of the arm 77 is supported to be vertically pivotable about the second arm support shaft 89. Further, the upper leading end of the arm cylinder 79 is connected to the base portion of the arm 77 to be pivotable about the upper cylinder support shaft 92. The second arm support shaft 89 and the second link support shaft 86, together with the first link support shaft 85, the first arm support shaft 88, the lower cylinder support shaft 91 and the upper cylinder support shaft 92, are configured to be visible from the outside of the machine body frame 1.

The rear connecting member 146 is disposed forwardly of the first arm support shaft 88 of the base portion of the arm 77 and also disposed on the connecting line L1 interconnecting the first arm support shaft 88 and the upper cylinder support shaft 92 at the base portion of the arm 77. Further, the rear connecting member 146 is disposed closer to the first arm support shaft 88 than the upper cylinder support shaft 92.

When the atm 77 is lowered with contraction of the arm cylinder 79, the rear connecting member 146 is located downwardly of the first arm support shaft 88. When the arm 77 is lifted up with expansion of the arm cylinder 79, the rear connecting member 146 is disposed upwardly of the first arm support shaft 88. And, the upper cylinder support shaft 92 is disposed forwardly of the rear connecting member 146. When the aim cylinder 79 is contracted to lower the arm 77, the upper cylinder support shaft 92 is located downwardly of the rear connecting member 146; whereas when the arm cylinder 79 is expanded to lift up the arm 77, the upper cylinder support shaft 92 is located upwardly of the rear connecting member 146. Further, the rear connecting member 146 is disposed at an intermediate position between the first arm support shaft 88 and the upper cylinder support shaft 92 at the base portion of the pair of right/left arms 77.

The rear connecting member 146 is disposed rearwardly of the cabin 4. The rear connecting member 146 an the cabin 4 are disposed apart from each other in the fore/aft direction so that no interference will occur between the cabin 4 and the rear connecting member 146 when the cabin 4 is rendered into the collapsed state under the lowered state of the arm 77.

The rear connecting member 146 is disposed at a position upwardly away from the hood upper wall 41 so that the hood upper wall 41 can be retained under the opened posture by the holding member 51 when the arm cylinder 79 is contracted to lower the arm 77.

Figure 11:
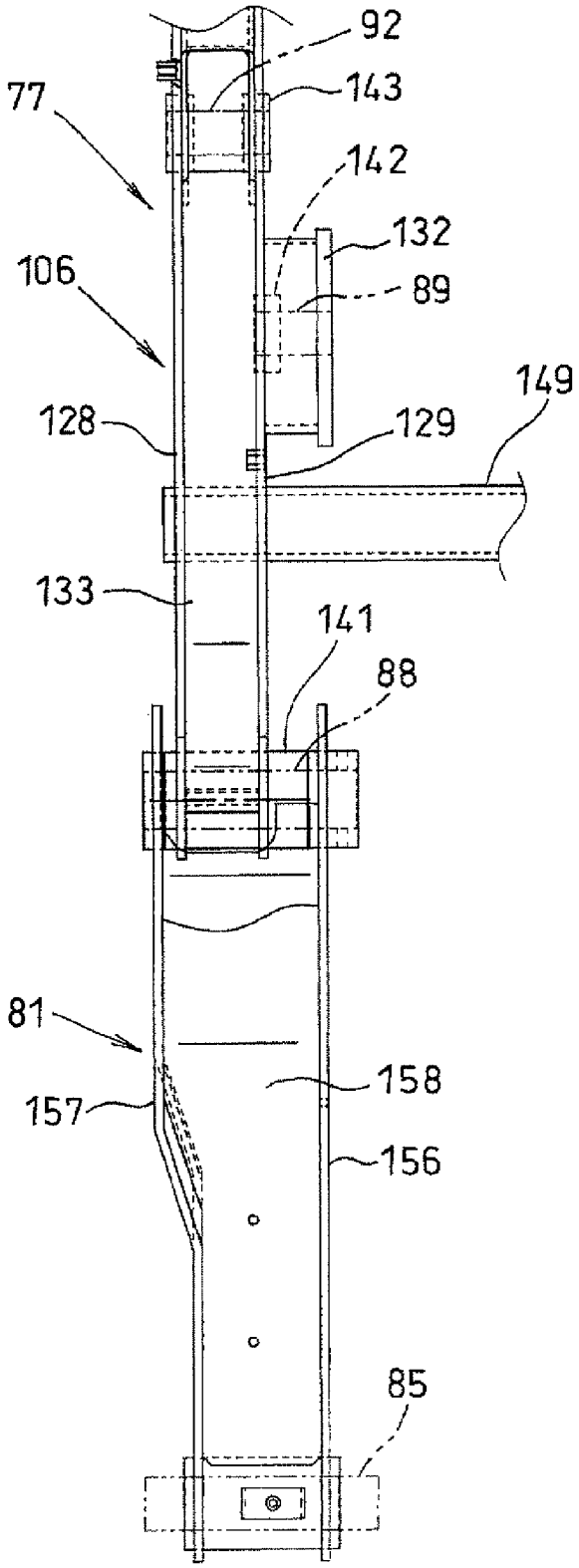
FIG. 11 is a rear view showing a first lift link and the arm when the arm is lifted up.

As shown in FIG. 11 and FIG. 12, the first lift cylinder 81 includes an inner wall 156 and an outer wall 157 and further includes a rear connecting wall 158 for interconnecting rear end portions of the inner wall 156 and the outer wall 157, and an intermediate connecting wall 159 for interconnecting fore/aft intermediate portions of the inner wall 156 and the outer wall 157.

Further, as shown in FIG. 11, the upper free end of each one of the pair of right/left first lift links 81 is formed wide so as to project on the outer side in the right/left direction than the lower base portion thereof. The base portions of the right/left arms 77 are supported with an outward offset in the right/left direction relative to the upper free ends of the pair of right/left first lift links 81. In this way, the base portion of the arm 77 is offset to the outer side in the right/left direction relative to the lower base portion of the first lift link 81.

Figure 8:
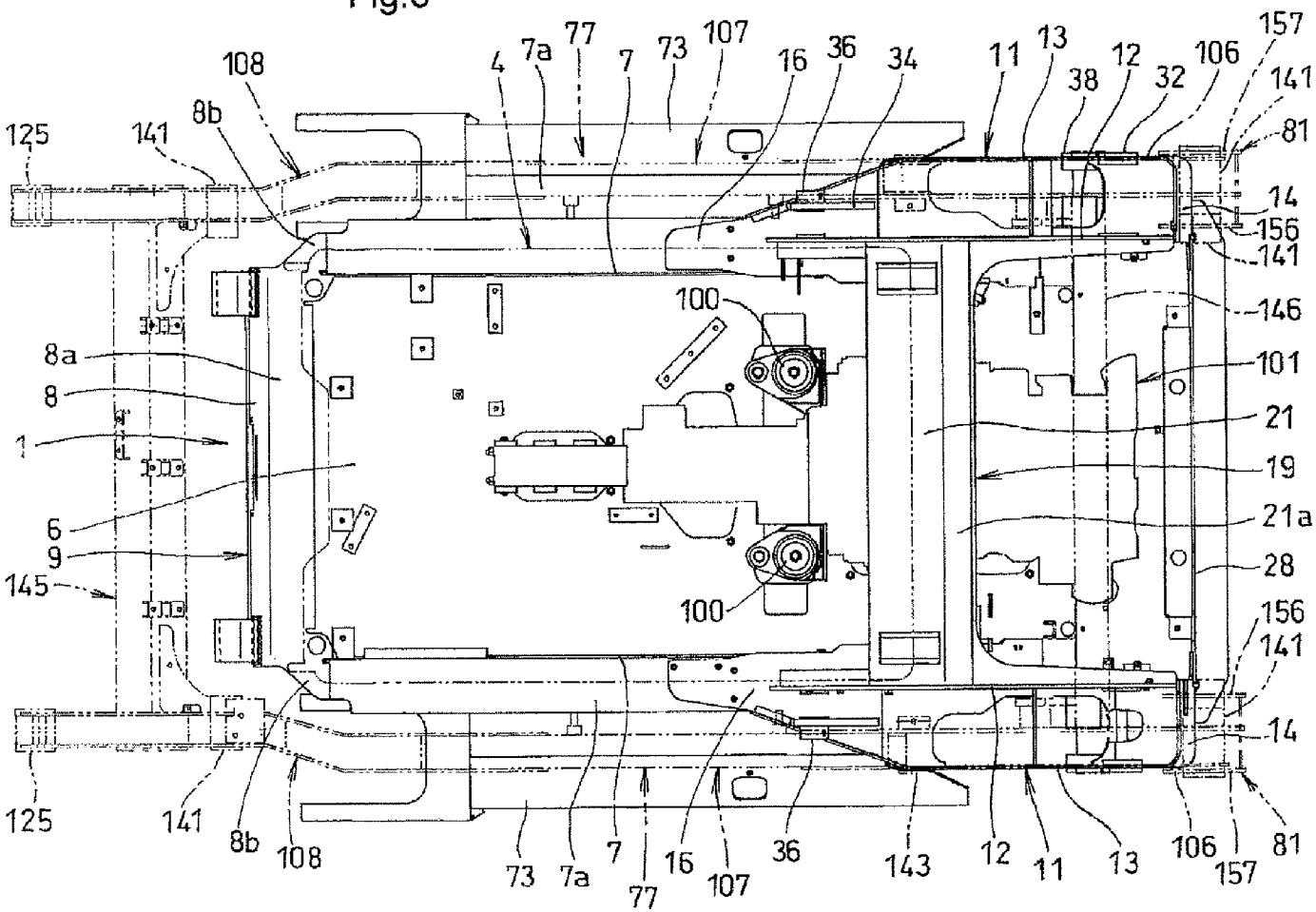
FIG. 8 is a plan view showing disposing relationship between the machine body frame and a cabin relative to the arms.

As shown in FIG. 8, the pair of right/left arms 77 are disposed on the right/left opposed sides of the machine body frame 1, the driving section 5 and the cabin 4. The distance between the pair of right/left arms 77 is set greater than the distance between the right/left side walls 7 of the frame body 9. The pair of right/left arms 77, along the entire lengths thereof, are disposed within the right/left width between the outer ends of the pair of right/left traveling devices 3 and also disposed outwardly of the right/left width between the inner ends of the pair of right/left traveling devices 3. The right/left width of the cabin 4 is set greater than the distance between the right/left side walls 7 of the frame body 9, and the right/left side portions of the cabin 4 project more outward in the right/left direction than the right/left side walls 7 of the frame body 9.

As shown in FIG. 1, FIG. 2, FIG. 8 and FIG. 9, intermediate portions on the front end sides of the pair of right/left arms 77 are bent inward in the right/left direction so that the right/left distance between the front end portions of the right/left arms 77 is smaller than the right/left distance between the rear end portions of the same, and between the front ends of the arms 77, a bucket (implement) 78 is connected via a pair of right/left brackets 95 by leading end connecting bosses 125 to be pivotable about a support shaft 97.

The bucket 78 is supported via the brackets 95 to the leading ends of the arms 77 to be pivotable about the support shaft 97. Bucket cylinders 98, each comprised of a double-acting type hydraulic cylinder, are interposed between the brackets 95 of the bucket 78 and the leading end side intermediate portions of the arms 77. With expansion/contraction of these bucket cylinders 98, the bucket 79 effects a pivotal movement (scooping/dumping operation).

Stopper mechanisms 161 are provided between the front ends of the pair of fight/left arms 77 and the front end of the machine body frame. When the arms 77 are lowered with contraction of the arm cylinders 79, the rearward reaction force applied to the fight/left arms 77 from the buckets (implement) 78 can be received by the machine body frame 1.

The stopper mechanisms 161 include a pair of right/left stoppers 162 projecting rearward from the front connecting member 145 and a pair of right/left receiving members 163 projecting forwardly from the front wall of the machine body frame 1. When the arms 77 are under the lowered state with contraction of the arm cylinders 79, the pair of right/left stoppers 162 respectively come into contact with or approach the pair of right/left receiving members 163 from the front sides thereof.

As shown in FIG. 11, one side of the base member 106 of the arm 77 adjacent the first connecting boss 141 is engaged between the upper end portion of the inner wall 156 and the upper end portion of the outer wall 157 of the first lift link 81. The first arm support shaft 88 after inserted into the first connecting boss 141 is further inserted through an upper end of the inner wall 156 and an upper end of the outer wall 157 of the first lift cylinder 81, and an upper free end of the first lift cylinder 81 is pivotally connected to the base member 106 of the arm 77 by the first arm support shaft 88. So that, the base of the arm 77 is supported to the upper free end of the first lift cylinder 81 to be vertically pivotable about the first arm support shaft 88.

As shown in FIG. 8, the pair of right/left first link links 81 are disposed respectively on the outer sides of the right/left side walls 7 of the frame body 9. The lower base portions of the pair of right/left first lift links 81 are pivotally supported by the first link support shaft 85 between the inner walls 12 and the outer walls 13 of the pair of right/left support frame members 11. The pair of right/left arms 77 are disposed on the outer side of the frame body 9, and the base portions of the pair of right/left arms 77 are pivotally supported by the first arm support shaft 88, on the outer sides of the side walls 7 of the frame body 9 and on the upper free end sides of the first lift links 81.

As shown in FIG. 9, FIG. 11 and FIG. 12, the upper leading end of the arm cylinder 79 is inserted between the outer wall 128 and the inner wall 129 of the base portion of the arm 77; and to the upper leading end of this arm cylinder 79, there is inserted the upper cylinder support shaft 92 which in turn is inserted into the third connecting boss 143; and the upper leading portion of the arm cylinder 79 is pivotally connected to the base portion of the arm 77 by the upper cylinder support shaft 92.

The free end of the second lift link 82 is inserted between the extension attaching wall 131 and the inner bracket 132; and the second arm support shaft 89 is inserted through the second connecting boss 142 to the free end of this second lift link 82. The free end of the second lift link 82 is pivotally connected via the second arm support shaft 89 to the base portion of the arm 77. With these, the base portion of the arm 77 is supported to the free end of the second lift link 82 to be vertically pivotable about the second arm support shaft 89, forwardly of the first arm support shaft 88. The second lift link 82 is disposed on the inner side in the right/left direction than the arm cylinder 79, so that the arm cylinder 79 and the second lift link 82 can cross each other as viewed laterally.

As shown in FIG. 1 and FIG. 2, the positional relationship among the first link support shaft 85, the second link support shaft 86, the first arm support shaft 88 and the second arm support shaft 89 is set such that the first lift link 81 as a whole may be confined to more front side than the rear end of the vehicle body (the rear end of the rear hood cover 40) of the loader work machine, over the entire range of lifting operation of the arm 77 from the lowered state with contraction of the arm cylinder 79 to the elevated state with expansion of the arm cylinder 79. Thus, the positional relationship among the first link support shaft 85, the second link support shaft 86, the first arm support shaft 88 and the second arm support shaft 89 is set such that the upper portion of the first lift link 81 may be confined to the more front side than the rear end of vehicle body of the loader work machine, throughout the lifting condition from the condition of the arm 77 being lowered with contraction of the arm cylinder 79 to the condition of the arm 77 being lifted up with expansion of the arm cylinder 79.

Further, the positional relationship among the first link support shaft 85, the second link support shaft 86, the first arm support shaft 88 and the second arm support shaft 89 is set such that the upper portion of the first lift link 81 may be in approximate agreement with the vehicle body rear end (rear end of the lid member 40) of the loader work machine, when the upper free end of the first lift link 81 is maximally pivoted rearward, in the course of transition from the condition of the arm 77 being lowered with contraction of the arm cylinder 79 to the condition of the arm 77 being lifted up with expansion of the arm cylinder 79. The first arm support shaft 88 is provided at the upper end of the first lift link 81. When the arm 77 is lifted up and the second link support shaft 86, the first arm support shaft 88 and the second arm support shaft 89 are brought into alignment along a single straight line, as shown by the chain line in FIG. 2, the first lift link 81 is maximally inclined rearward. Under this condition, the first arm support shaft 88, provided at the upper end of the first lift link 81, is located forwardly of the vehicle body rear end (the rear end of the rear hood cover 40) of the loader work machine (track loader).

When the arm 77 assumes the lowered state with contraction of the arm cylinder 79, the second arm support shaft 89 projects toward the first link support shaft 85, than the segment interconnecting the second link support shaft 86 and the first atm support shaft 88, so that the segment interconnecting the second link support shaft 86 and the second arm support shaft 89 intersects at an obtuse angle with the segment interconnecting the first arm support shaft 88 and the second arm support shaft 89. With this arrangement, when the arm 77 is lowered in response to contraction of the arm cylinder 79, the first lift link 81 will be pivoted rearward about the first link support shaft 85 and then pivoted back slightly forwardly. The first lift link 81 is formed longer than the second lift link 82, so that the distance between the first link support shaft 85 of the first lift link 81 and the first arm support shaft 88 is set longer than the distance between the second link support shaft 86 of the second lift link 82 and the second arm support shaft 89. And, the distance between the first arm support shaft 88 and the second arm support shaft 89 is set shorter than the length of the first lift link 81, and also shorter than the distance between the first link support shaft 85 and the first arm support shaft 88. Further, the second link support shaft 86 is disposed forwardly of the drive shaft 71 of the traveling device 3.

According to the above-described embodiment, the lower side of the transverse connecting member 19 constitutes the hood 39 for accommodating the engine 101. The upper wall plate 21 of the transverse connecting member 19 is disposed more downwardly than the vertical center of the cabin 4. The rear portion 21*a* of the upper wall plate 21 is downwardly inclined rearward. The hood upper wall 41 is provided for covering the rear upper side between the pair of right/left support frame members 11. The front end portion of the hood upper wall 41 is connected to the rear portion 21*a* of the upper wall plate 21 of the transverse connecting member 19. And, the hood upper wall 41 is downwardly inclined rearward, in correspondence with the rear portion 21*a* of the upper wall plate 21. Therefore, in comparison with the height of the cabin 4, the height of the entire hood 39 disposed rearwardly of the cabin 4 can be restricted, so that the hood 39 hardly interferes with the rear visibility. For this reason, the worker can also see, from the inside of the cabin 4, the rear lower side of the hood 39, so that the work by the loader work machine can be carried out more smoothly.

Further, the support shaft 55 acting as the pivot for the cabin 4 is disposed on the back side of the cabin 4 and at the vertical center of the cabin 4. And, the hood 39 is disposed downwardly of the support shaft 55 acting as the pivot of the cabin 4; and the upper face of the hood 39 is disposed horizontally or downwardly inclined rearward, so as not to project more upward than the support shaft 55. Therefore, the upper face of the hood 39 is located, along its entire length in the fore/aft direction, downwardly of the support shaft 55 and also disposed horizontally or downwardly inclined rearward, so that the worker in the cabin 4 can readily see the wide range of the rear lower side of the hood 39, so that the work can be carried out even more smoothly.

Further, as the height h1 from the lower end of the machine body frame 1 to the rear end of the hood upper wall 41 is set to be equal to or less than ½ of the height H1 from the lower end of the machine body frame 1 to the upper end of the cabin 4. Hence, compared with the height H1 to the upper end of the cabin 4, the height h1 to the rear end of the upper wall 41 can be restricted, and the worker can see, from inside the cabin 4, the rear lower side of the rear end of the hood upper wall 41. So, in this regard too, the work can be carried out even more smoothly.

Further, at the rear end portion of the machine body frame 1, there is provided the lid member 40 for covering the rear end opening between the pair of right/left support frame members 11 and the upper wall portion 4*a* of the lid member 40 is downwardly inclined in correspondence with the hood upper wall 41. So, the upper wall portion 40*a* of the lid member 40 does not interfere with the rear view. In this respect, the rear visibility can be improved.

Further, the upper wall plate 21 of the transverse connecting member 19 is disposed upwardly of the seat portion 63*a* of the driver's seat 63 provided inside the cabin 4 and also disposed downwardly of the upper end of the backrest 63*b* of the driver's seat 63. Therefore, the worker in the cabin 4 can see, as being seated at the driver's seat 63, the rear lower side of the upper wall plate 21 of the transverse connecting member 19 from the upper side of the backrest 63*b*. In this respect too, the work can be carried out smoothly.

According to the foregoing embodiment, at the leading end portions of the pair of right/left arms 77, there is provided the front connecting member 145 interconnecting the pair of right/left arms 77 and at the base portions of the pair of right/left arms 77, there is provided the rear connecting member 146 interconnecting the pair of right/left arms 77, so that the pair of right/left arms 77, the front connecting member 145 and the rear connecting member 146 together constitute a rectangular framework. With this, the rigidity of the pair of right/left arms 77 can be enhanced and even if e.g. a significant shock is received from the implement 78 provided at the leading ends of the arms 77 during a work, it is possible to prevent mutual contortion or looseness of the pair of right/left arms 77, Further, the rear connecting member 146 is disposed on the connecting line L1 interconnecting the first arm support shaft 88 and the upper cylinder support shaft 92 at the base portions of the pair of right/left arms 77. With this, when a driver located at the driving section 5 effects a work with viewing the rear side, the driver can guess with a certain level of accuracy, the height position of the implement 78 disposed at the leading end of the arm 77, by seeing the height of the rear connecting member 146 present on the rear side, so that the driver can effect the work easily.

Further, the rear connecting member 146 is disposed more forwardly than the first arm support shaft 88, and located closer to the first arm support shaft 88 extending at the base portion of the arms 77, than the upper cylinder support shaft 92. Therefore, when the arm cylinder 79 lifts up/down the arm 77 in association with expansion/contraction thereof, occurrence of looseness of the right/left lift link 81 to the right or left can be avoided reliably by the rear connecting member 146.

Further, the rear connecting member 146 is disposed upwardly apart from the upper hood cover 41 so that the upper hood cover 41 may be held under its opened posture by the holding member 51 when the arm 77 is lowered in response to contraction of the arm cylinder 79. Therefore, even when the arm 77 is lowered, the hood upper wall 41 can be held under the opened posture by the holding member 51, thus providing convenience for e.g. inspection of the inside of the hood 39.

In the above embodiment, the inner walls 12 and the outer walls 13 of the pair of right/left support frame members 11 are disposed on the outer sides of the side walls 7 of the frame body 9 and the pair of right/left first links 81 are disposed respectively on the outer sides of the pair of right/left side walls 7 of the frame body 9. The lower base portions of the pair of right/left first lift links 81 are pivoted by the first link support shaft 85 between the inner walls 12 and the outer walls 13 of the pair of right/left support frame members 11. The base portions of the pair of right/left arms 77 are pivoted by the first arm support shaft 88, on the outer side of the side wall 7 of the frame boy 9 and on the upper free end side of the first lift link 81. The pair of right/left arms 77 are disposed on the outer side of the frame body 9. Accordingly, it is possible to cause the right/left sides of the cabin 4 mounted on the vehicle frame 1 to project more outwardly in the right/left direction than the right/left side walls 7 of the frame body 9. Thus, it is possible set the right/left width of the cabin 4 to be greater than the distance between the right/left side walls 7 of the frame body 9. So, even when e.g. the right/left width of the frame body 9 is made shorter to form the loader work machine compact, sufficient right/left width for the cabin 4 can be ensured for enhancing the comfort inside the cabin 4.

The inner side of attaching plate 16 is fixed to the rear end portion of the side wall 7 of the frame body 9. The outer side of the attaching plate 16 projects laterally outwardly from the upper end of the side wall 7 of the frame body 9. The inner wall 12 and the outer wall 13 are disposed on the outer side of the side wall 7 of the frame body 9, and front lower ends of the inner wall 12 and the outer wall 13 are fixed to the upper face of the outer portion of the attaching plate 16. Thus, the attaching plate 16 is interposed between the rear end portion of the side wall 7 of the frame body 9 and the inner/outer walls 12, 13 of the support frame member 11. In this way, while securing sufficient rigidity of the machine body frame 1, the fight/left support frame members 11 can be arranged laterally outwardly of the frame body 9. So that, the distance between the fight/left support frame members 11, the distance between the right/left first lift links 81 and the distance between the pair of right/left arms 77 can be set greater than a right/left width of the frame body 9. In this regard too, sufficient right/left width for the cabin 4 can be ensured for enhancing the comfort inside the cabin 4.

Further, the base portions of the arms 77 are offset to the outer side in the right/left direction relative to the lower base portions of the first lift link 81. Therefore, the distance between the pair of right/left arms 77 at the base portions thereof can be set greater than the distance between the lower base portions of the first lift link 81, and than the distance between the right/left support frame members 11 of the machine body frame 1. In this regard too, the distance between the pair of right/left arms 77 can be set greater than the right/left width of the frame body 9. So that, sufficient right/left width for the cabin 4 can be ensured for enhancing the comfort inside the cabin 4.

The upper free end portion each of the pair of right/left lift links 81 are provided with a greater width so as to project more outward in the right/left direction than the lower end portions thereof. And, the base portions of the pair of right/left arms 77 are supported with an offset toward the right/left outer side, relative to the upper free ends of the pair of right/left first lift links 81. Thus, with the simple construction, it is possible to offset the base portions of the pair of right/left arms 77, relative to the lower base portions of the pair of right/left first lift links 81. As a result, compared with the distance between the lower base portions of the pair of right/left first lift links 81 and the distance between pair of right/left support frame members 11 of the machine body frame 1, the distance between the base portions of the pair of right/left arms 77 can be set larger.

Further, the pair of right/left arms 77, along the entire lengths thereof, are disposed within the right/left width between the outer ends of the pair of right/left traveling devices 3 and also disposed outwardly of the right/left width between the inner ends of the pair of right/left traveling devices 3. Therefore, while sufficient right/left width can be ensured for the cabin 4 for enhancing the occupant's comfort in the cabin 4, it is still possible to confine the right/left width of the entire loader work machine including the pair of right/left traveling devices 3, within the right/left width of the pair of right/left traveling devices 3. So, there is no enlargement of the loader work machine, thus not impairing the working performance in a small place.

According to the above embodiment, from the inner wall 129 of the base portion of the arm 77, the extension attaching wall 131 extends and project downward; and to the right/left inner side of the extension attaching wall 131, there is provided the inner bracket 132 opposed to the extension attaching wall 131. The upper free end of the first lift link 81 and the upper leading end of the arm cylinder 79 are pivotally connected between the inner wall 129 and the outer wall 128 of the base portion of the arm 77. And, the free end portion of the second lift link 82 is pivotally connected between the extension attaching wall 131 and the inner bracket 132. Therefore, in order to pivotally connect the upper free end of the first lift link 81 and the upper leading end of the arm cylinder 79 to the base of the arm 77, the first arm support shaft 88 and the upper cylinder support shaft 92 will be inserted from the outer side of the arm 77 into the outer wall 128 and the inner wall 129 of the base of the arm 77 and into the upper free end of the first lift link 81 or the upper leading end of the arm cylinder 79, whereby the upper free end of the first lift link 81 and the upper leading end of the arm cylinder 79 can be easily connected to the base of the arm 77. Also, even in the case of connecting the free end of the second lift link 92 between the inner wall 129 and the inner bracket 132 at the base of the arm 77, the extension attaching wall 131 will project more downward from the inner wall 129 of the base of the arm 77, than the lower edge of the outer wall 128. Therefore, the outer wall 128 of the base of the arm 77 will not present any obstacle, and the second arm support shaft 89 can be easily inserted from the outer side of the arm 77 into the extension attaching wall 131 and the inner bracket 132 at the base of the arm 77 and into the free end of the second lift link 82. For this reason, the operation of connecting the first lift link 81, the second lift link 82 and the arm cylinder 79 to the base of the arm 77 is facilitated.

Further, when grease (lubricant) is to be injected to the connecting portion (support shaft portion) between the first lift link 81, the arm cylinder 79 and/or the second lift link 82 and the arm 77, the grease can be easily injected, from the outer side of the arm 77, to the upper free end of the first lift link 81 or the connecting portion between the upper leading end of the arm cylinder 79 and the base of the arm 77. Also, when grease is to be injected to the connecting portion between the free end of the second lift link 82 and the base of the arm 77, the outer wall 128 extending along the base of the arm 77 does not present any obstacle, so the grease can be easily injected, from the outer side of the arm 77, to the connecting portion between the free end of the second lift link 82 and the base of the arm 77. So that, the operation of grease injection is facilitated.

Further, at the base of the arm 77, there are provided the upper connecting wall 133 disposed along the upper edges of the inner wall 129 and the outer wall 128; and the lower connecting wall 134 disposed along the lower edges of the inner wall 129 and the outer wall 128, and the inner wall 129 and the outer wall 128 at the base of the arm 77 are interconnected via the upper connecting wall 133 and the lower connecting wall 134. The inner bracket 132 is connected to the inner face of the extension attaching wall 131 or the inner face of the inner wall 128 of the arm 77, by the bracket connecting wall 136 disposed along the upper edge of the inner bracket 132; and an intermediate portion of the bracket connecting wall 136 projects more upward than the lower connecting wall 134 so that the bracket connecting wall 136 and the lower connecting wall 134 intersect with each other as viewed sideways. Therefore, due to the intersection of the bracket connecting wall 136 and the lower connecting wall 134, the projecting base portion of the extension attaching wall 131 of the arm 77 can be reinforced by the cooperation between the bracket connecting wall 136 and the lower connecting wall 134, so that the support of the second lift link 82 by the extension attaching wall 131 and the inner bracket 132 can be reinforced.

According to the above embodiment, the positional relationship among the first lift support shaft 85, the second link support shaft 86, the first arm support shaft 88 and the second arm support shaft 89 is set such that the upper portion of the first lift link 81 may be in substantial agreement with the machine body rear end of the loader work machine, when the upper free end of the first lift link 81 is maximally pivoted rearward, in the course of transition from the condition of the arm 77 being lowered by contraction of the arm cylinder 79 to the condition of the arm 77 being raised by expansion of the arm cylinder 79. Therefore, in the entire process of lifting up/down the arm 77, there occurs no significant rearward projection of the first lift link 81, beyond the rear end of the machine body of the loader work machine. So that, it is possible to avoid contact between the first lift link 81 and an object present rearwardly of the loader work machine during work. Therefore, when the loader work machine is moved rearward, contact between the first lift link 81 and an object present rearward can be avoided. And, as the first lift link 81 does not project significantly rearward, the workability in a small place is improved. Further, if the first lift link 81 significantly projected rearward, the presence of the first lift link 81 would interfere with the obliquely rear view, thus impairing the oblique rearward visibility. With the present invention, however, as the first lift link 81 does not significantly project rearward, the oblique rearward visibility is improved.

Also, the first arm support shaft 88 is provided at the upper end of the first lift link 81; and the first lift link 81 is inclined upwardly rearward about the first link support shaft 85 so that when the arm 77 is lifted up/down to bring the second link support shaft 86, the first arm support shaft 88 and the second arm support shaft 89 into linear alignment, the first arm support shaft 88 extending at the upper end of the first lift link 81 may be located forwardly of the rear end of the machine body of the loader work machine. So, even when the upper free end of the first lift link 81 is maximally pivoted rearward, the first lift link 81 may project more rearward than the machine body rear end of the loader work machine, but this is only slight rearward projection of the upper portion of the first lift link 81. Therefore, there will hardly occur interference by the first lift link 81 during work.

Further, when the arm 77 is lowered with contract of the arm cylinder 79, the second arm support shaft 89 projects closer to the first link support shaft 85 than the segment interconnecting the second link support shaft 86 and the first arm support shaft 88, and the segment interconnecting the second link support shaft 86 and the second arm support shaft 89 intersects the segment interconnecting first arm support shaft 88 and the second arm support shaft 89, at an obtuse angle. Because of this, when the arm 77 is lowered with contraction of the arm cylinder 79, the first lift link 81 will be pivoted back slightly to the front side after pivoting rearward about the first link support shaft 85. Therefore, the maximal rearward pivotal movement of the upper free end of the first lift link 81 occurs only in the course of the lifting movement of the arm 77. And, even if the first lift link 81 projects more rearward than the machine body rear end of the loader work machine, this occurs only during the short period in the course of the lifting up/down of the arm 77. So, in this respect too, there occurs no obstacle by the first lift link 81 during a work.

Incidentally, in the foregoing embodiment, the rear connecting member 146 and the cabin 4 are disposed apart from each other in the fore/aft direction so that no interference will occur between the cabin 4 and the rear connecting member 146 under the collapsed state of the cabin 4 when the arm 77 is lowered. Instead of this, an alternative arrangement is possible in which if the cabin 44 is rendered into the collapsed state with the arm 77 being lowered, the rear face of the cabin 4 contacts the rear connecting member 146, thus maintaining the cabin 4 under the collapsed state.

Further, in the foregoing embodiment, grease is injected to the connection portion between the first lift link 81, the arm cylinder 79 and/or the second lift link 82 and the arm 77. Instead, lubricant oil other than grease may be injected to the connection portion between the first lift link 81, the arm cylinder 79 and/or the second lift link 82 and the arm 77.

Further, in the foregoing embodiment, the cabin 4 is employed as a driver protecting device surrounding the driving section 5. Instead of the cabin 4, a ROPS or the like may be employed as a driver protecting device surrounding the driving section 5.

Further, in the foregoing embodiment, the track frames 73 of the pair of right/left traveling devices 3 are attached integrally by means of welding to the pair of right/left side walls 7 of the frame body 9. Instead of this, the track frames 73 of the pair of right/left traveling devices 3 may be detachably attached by means of fasteners such as bolts/nuts to the pair of right/left side walls 7 of the frame body 9.

Further, in the foregoing embodiment, the pair of right/left traveling devices 3 comprise crawler traveling devices having the crawlers 70 entrained about the driven wheels 68 and the drive wheel 69. Instead, the pair of right/left traveling devices may be tired front wheels and tired rear wheels.

Other Embodiment

Figure 13:
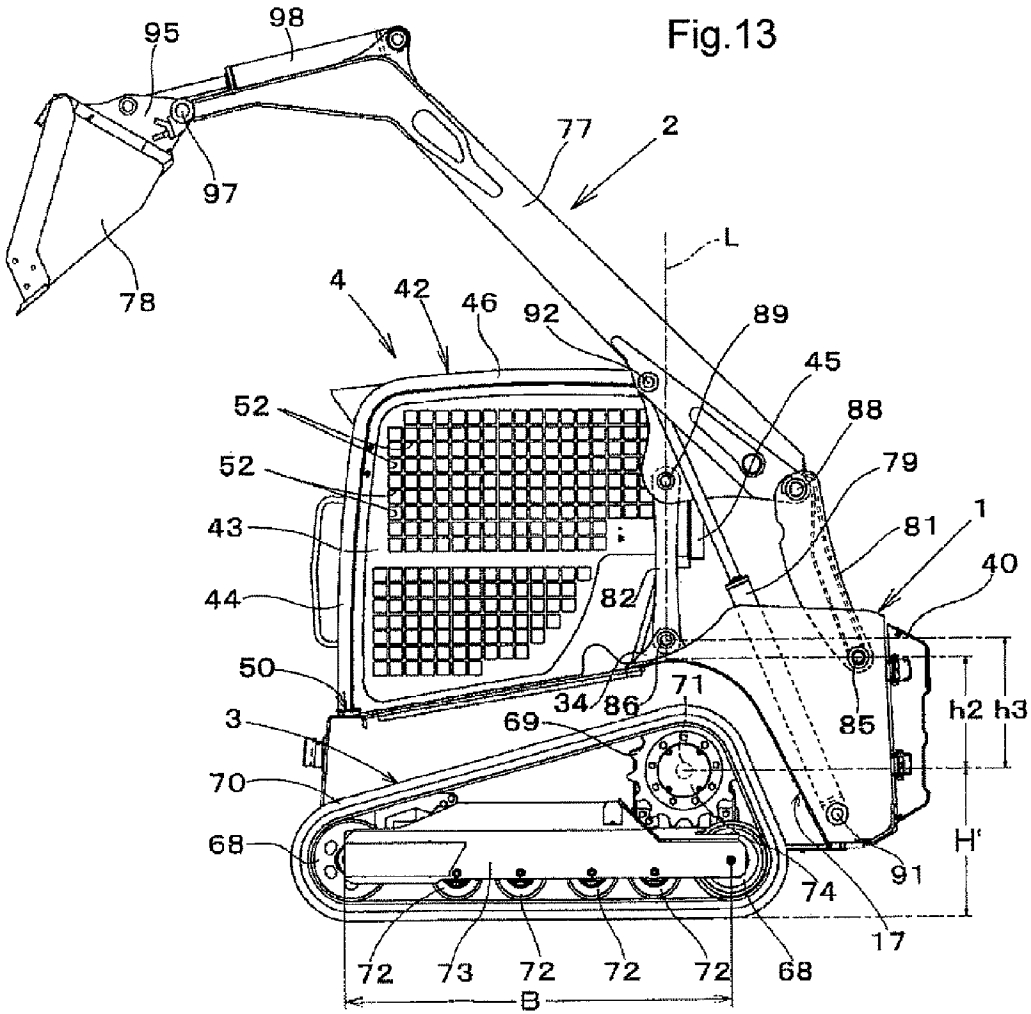
FIG. 13 is a side view showing a further embodiment of the present invention, showing a track loader with a boom being lifted up.
Figure 14:
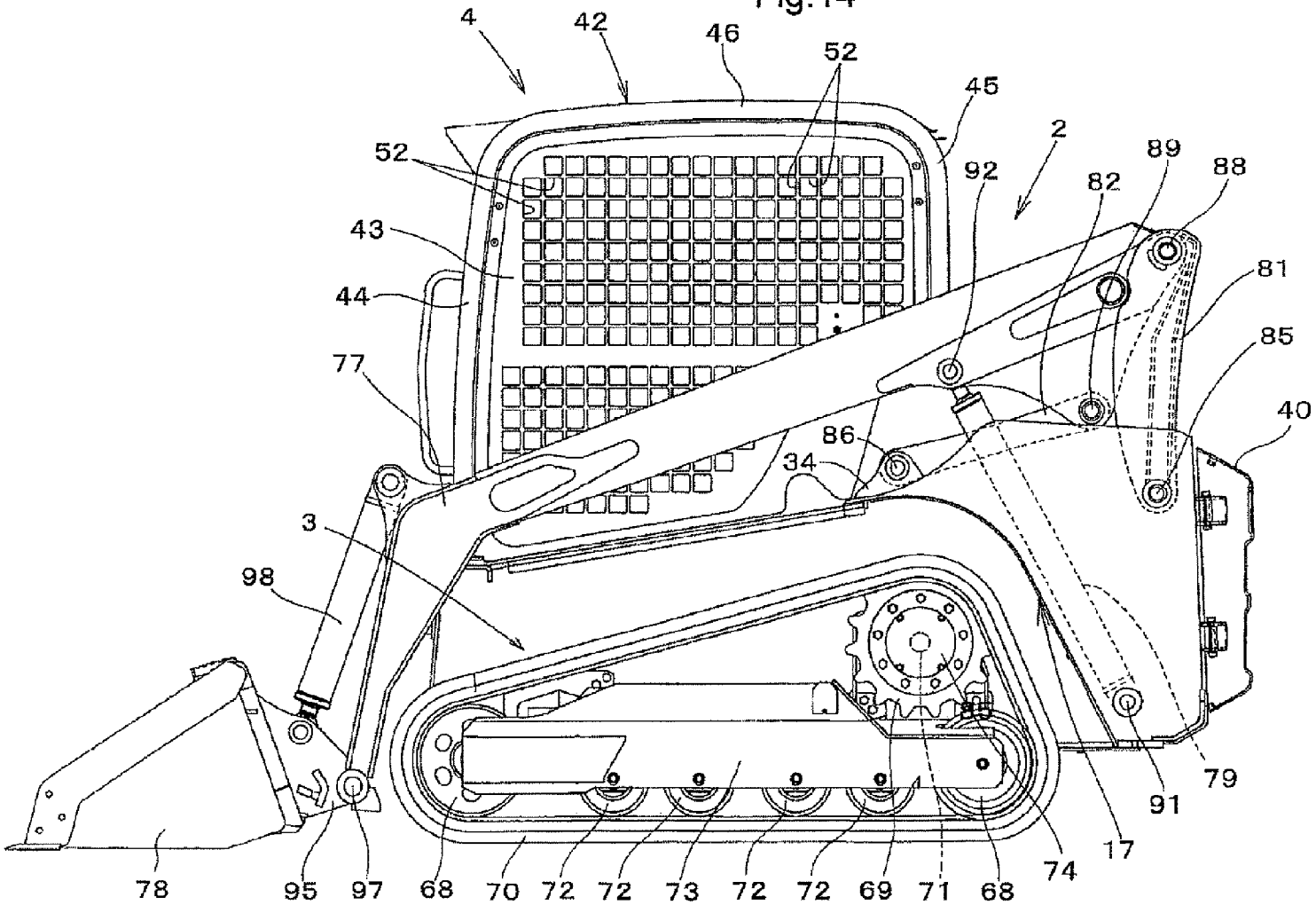
FIG. 14 is a side view of the track loader with the boom being lowered.

Next, a further embodiment of the present invention will be described with reference to the drawings. In FIGS. 13 and 14, a track loader relating to the present invention, like the foregoing embodiment, includes a machine body frame 1, a loader implement (excavating implement) 2 mounted on the machine body frame 1, and a pair of right/left traveling devices 3 supporting the machine body frame 1. On a front portion of the machine body frame 1, there is mounted a cabin 4.

As shown in FIG. 14, when a boom cylinder 79 is contracted to lower a boom 77, an upper cylinder support shaft 92 is located forwardly of a second boom support shaft 89 and rearwardly of a second link support shaft 86, and the second link support shaft 86 and the second boom support shaft 89 are located downwardly of the upper cylinder support shaft 92, so that as viewed sideways, the boom cylinder 79 and the second lift link 82 intersect with each other in the form of a cross.

Further, as shown in FIG. 13, when the boom cylinder 79 is expanded to lift up the boom 77, the second boom support shaft 89 is located upwardly of the second link support shaft 86 and the upper cylinder support shaft 92 is located upwardly of the second boom support shaft 89, so that the second boom support shaft 89, the second link support shaft 86 and the upper cylinder support shaft 92 are aligned substantially linearly in the vertical direction. That is, when the boom cylinder 79 is expanded and the boom 77 is lifted up, the second boom support shaft 89 is located upwardly of the second link support shaft 86 and the second lift link 82 is oriented vertically, the upper cylinder support shaft 92 is located upwardly of the second boom support shaft 89, and the upper cylinder support shaft 92 is located slightly forwardly of an upper extension line L of the second lift link 82.

A height h2 from a drive shaft 71 to the first link support shaft 85 and a height h3 from the drive shaft 71 to the second link support shaft 86 are set shorter than a height H' from the lower end of the traveling device 3 to the drive shaft 71. The lower cylinder support shaft 91 is disposed rearwardly and downwardly of the drive shaft 71 of the traveling device 3, and the first link support shaft 85 is disposed rearwardly and upwardly of the drive shaft 71 of the traveling device 3.

Further, a ground contacting width B in the fore/aft direction of the pair of right/left traveling device 3, which is the fore-aft width between the centers of the pair of front and rear driven wheels 68, is set to be equal to or greater than a half of the fore/aft width of the machine body frame 1. And within the fore-aft ground-contacting width B of the pair of right/left traveling devices 3, the drive shaft 71 and the second link support shaft 86 are disposed, and the second link support shaft 86 is disposed forwardly of the drive shaft 71 and with an offset toward the center of the fore/aft ground contacting width B.

When the boom cylinder 79 is expanded to lift up the boom 77, the second boom support shaft 89, together with the second link support shaft 86, is disposed within the fore/aft ground contacting width B of the traveling device 3. Further, the lower cylinder support shaft 91 is disposed rearwardly of the traveling device 3; and the upper cylinder support shaft 92 is set at a position within the fore-aft ground contacting width B of the traveling device 3 over the lowered state of the boom 77 with contraction of the boom cylinder 79 and also over the elevated state of the boom 77 with expansion of the boom cylinder 79. The cabin 4 is mounted on the machine body frame 1 and this cabin 4 is configured such that most portion of the cabin 4 may be confined within the fore/aft ground contacting width B of the traveling devices 3, with the cabin being disposed upwardly of the traveling devices 3.

In the fore/aft direction, the second link support shaft 86 is substantially in flush with the rear face of the cabin 4 and the first link support shaft 85 is at substantially same height as the top of a fender 17. The first boom support shaft 88, the upper cylinder support shaft 92 and the second boom support shaft 89 are arranged in a triangular layout, with the second boom support shaft 89 being lowermost. Further, arrangement is provided such that when a bucket 78 is plunged into the ground, the second lift link 82 is located substantially parallel with a line interconnecting the bucket 78 and the first link support shaft 85. The first link support shaft 85 is located at half the height from the lower end (ground contacting face) of the traveling device 3 and to the cabin 4 ceiling. The lower cylinder support shaft 91 is disposed rearwardly of the traveling device 3 and forwardly of the first link support shaft 95.

Figure 15:
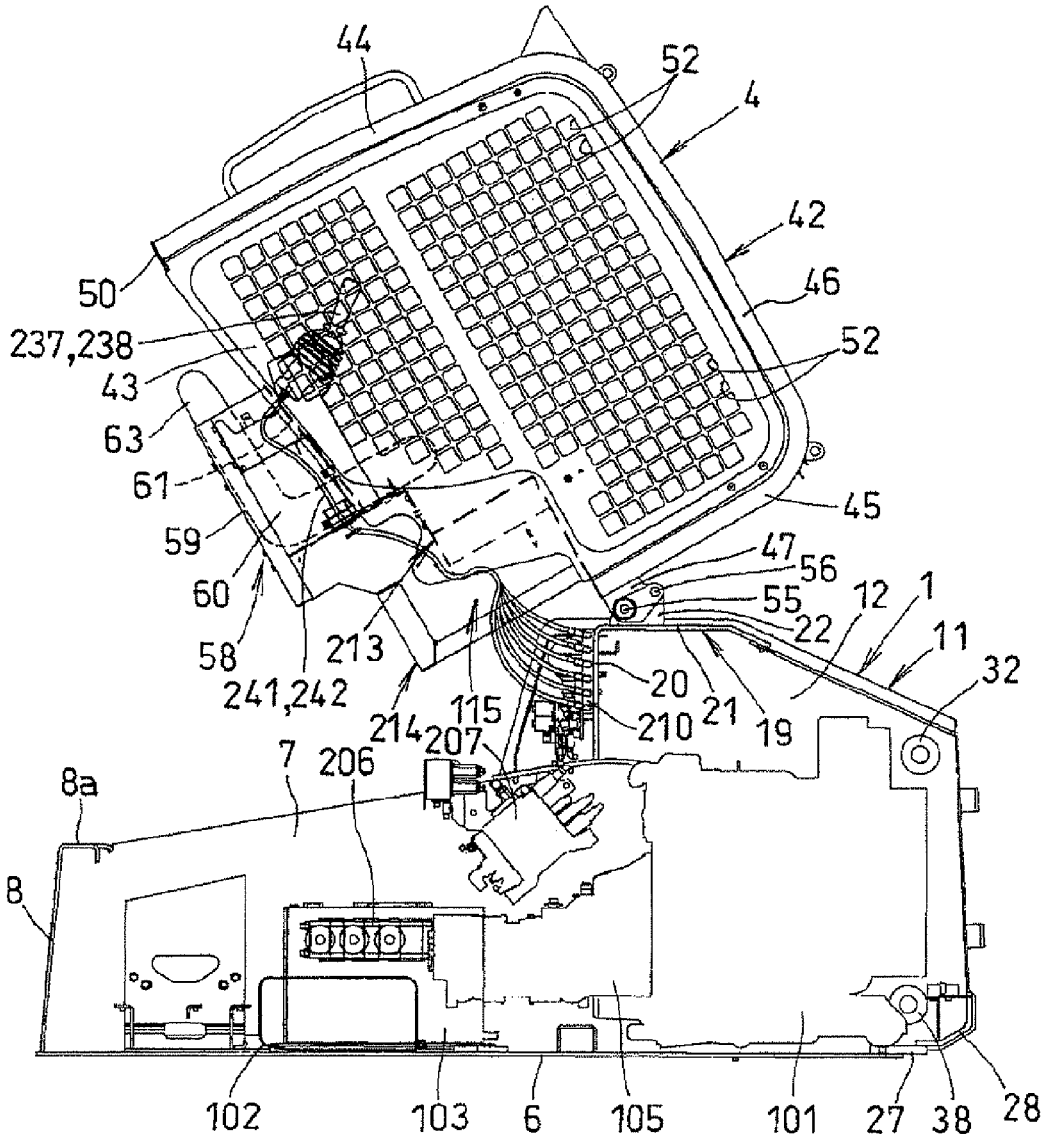
FIG. 15 is a side view in section of the track loader.
Figure 16:
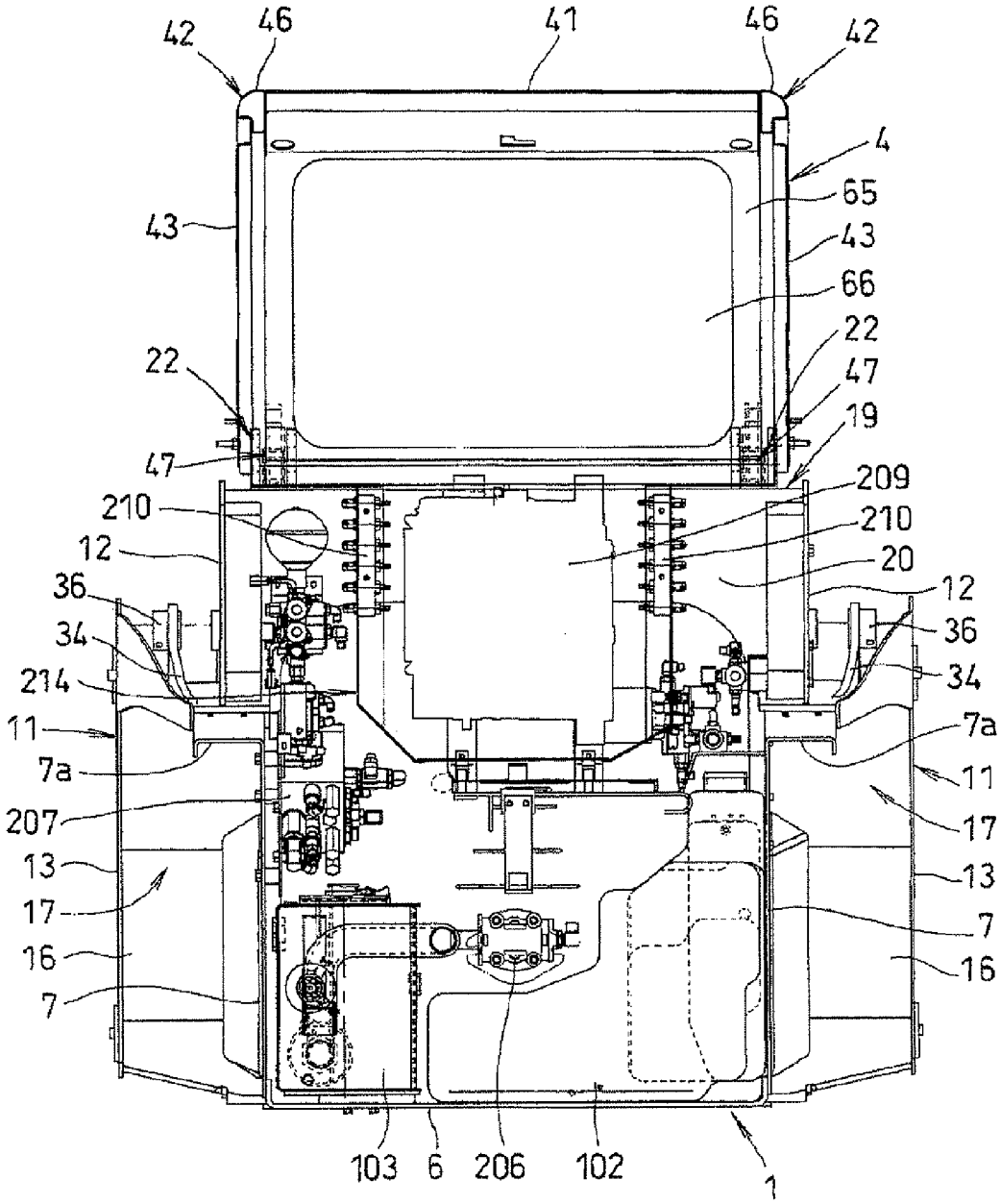
FIG. 16 is a front view in section of the track loader.
Figure 17:
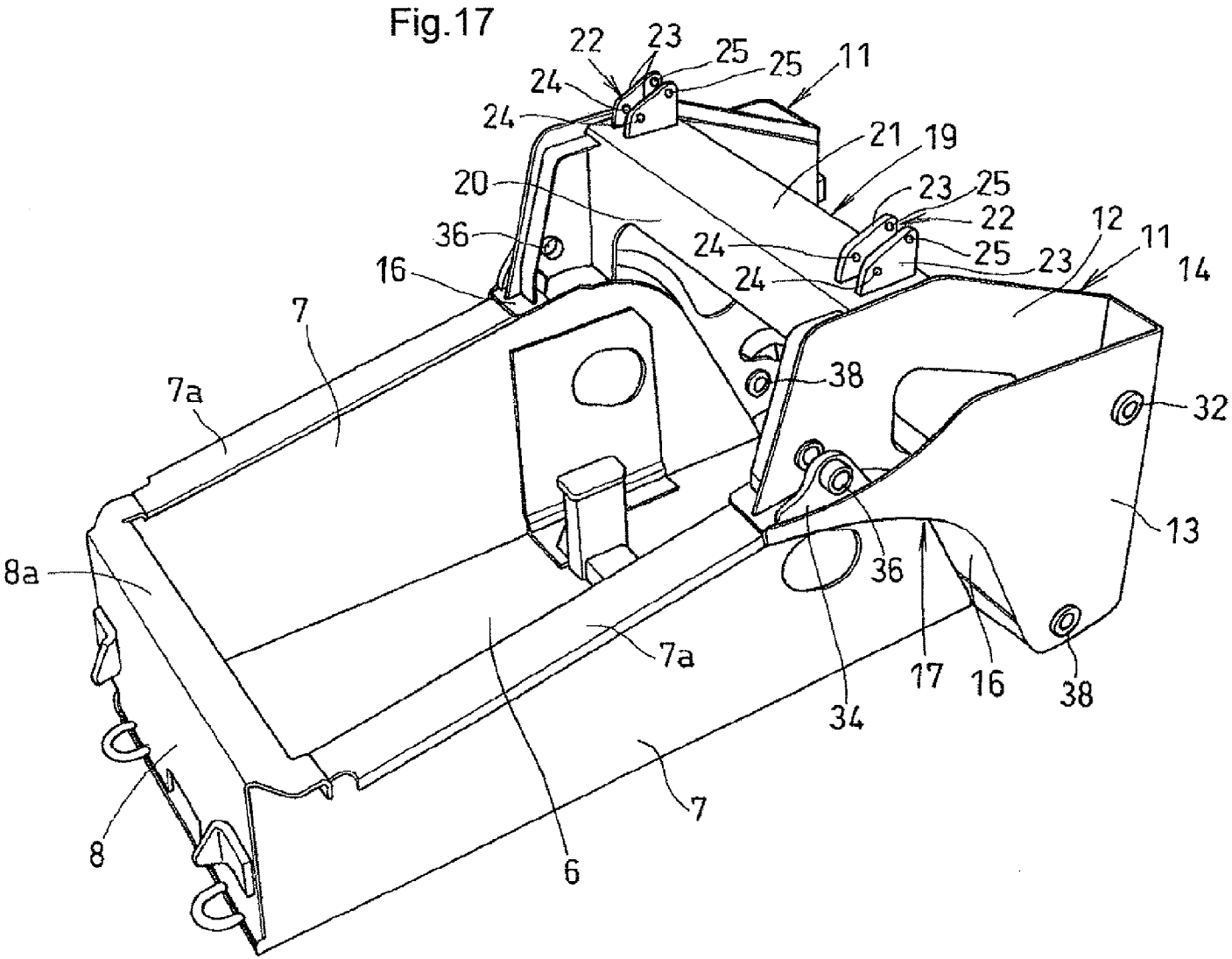
FIG. 17 is a perspective view of a machine body frame.
Figure 18:
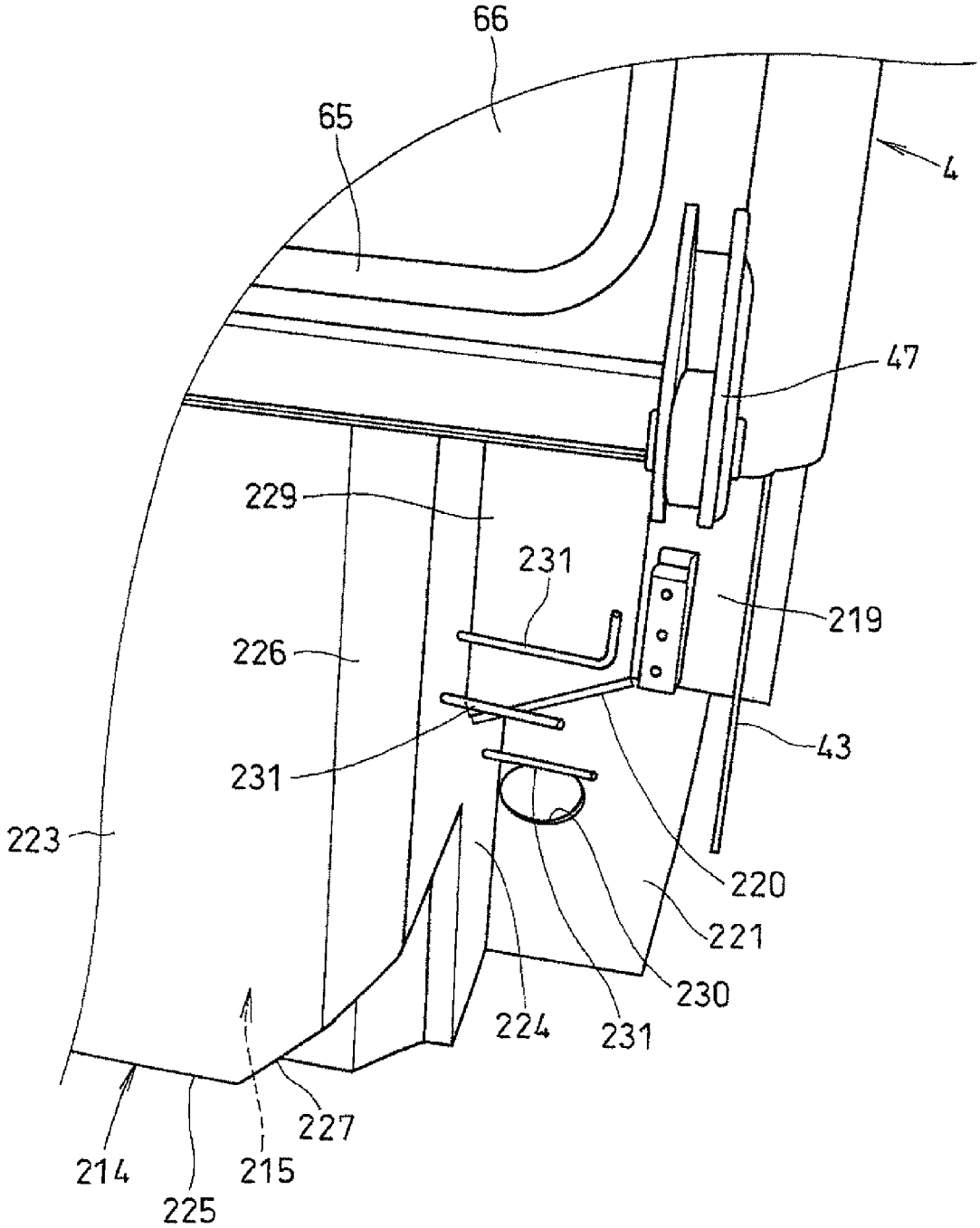
FIG. 18 is a perspective view showing a cabin lower portion as viewed from its rear side.

In FIG. 15, FIG. 16 and FIG. 17, rearwardly and on a bottom wall 6 of the machine body frame 1, an engine 101 is provided. On a front side on the bottom wall 6 of the machine body frame 1, there are provided a fuel tank 102 and a work oil tank 103. Forwardly of the engine 101, there is provided a traveling hydraulic control device 105. Forwardly of the traveling hydraulic control device 105, a triple, gear pump 206 is provided. At a fore/aft intermediate portion of the right side wall 7, an implement control valve (hydraulic control device) 207 is provided.

The traveling hydraulic control device 105 feeds/discharges the work oil in the work oil tank 103 by the power of the engine 101 to/from a pair of right/left traveling motors 74, thus controlling driving of the pair of right/left traveling motors 74. The gear pump 206 inputs the power of the engine 101 via the traveling hydraulic control device 105 and feeds/discharges the work oil of the work oil tank 103 to/from the boom cylinder 79 and the bucket cylinder 98 via the implement control valve 207. The implement control valve 207 controls driving of the boom cylinder 79 and the bucket cylinder 98, thus causing the boom cylinder 79 and the bucket cylinder 98 to be expanded/contracted.

In FIG. 15, FIG. 16 and FIGS. 20-22, at the right/left center of the rear face of the cabin 4, there is provided an air conditioner body 209 and on the right/left opposed sides of the air conditioner body 209, there are provided relay members 210 of pilot hoses.

Forwardly into the rear end lower portion of the cabin 4, there is provided a lower back wall 213; and rearwardly of this lower back wall 213, there is provided a closing member 214. Between the lower back wall 213 of the cabin 4 and the closing member 214, an air conditioner accommodating portion 215 is formed and in this air conditioner accommodating portion 215, the air conditioner body 209 is accommodated.

The air conditioner accommodating portion 215 has an upper end opening 216 opened into the cabin 4.

The air conditioner body 209 includes an evaporator configured to evaporate coolant to absorb heat from the ambience, thus rendering the surrounding into low temperature condition, so that air introduced through an inside air inlet or outside air inlet of the air conditioner body 209 is cooled and this air conditioned air is sent out therefrom.

Further, an air conditioner hose connected to the air conditioner body 209 is disposed in e.g. a side frame member 42 of the cabin 4 to be inserted into the cabin 4. In operation, the air-conditioned air from the air conditioner body 209 is set out through the air conditioner hose to e.g. the upper side of a driver's seat 63 in the cabin 4.

Incidentally, on the side of the machine body frame 1 mounting the engine 101, there are provided a compressor for compressing the coolant, a heat discharger (condenser) for discharging heat from the coolant compressed by the compressor to be condensed/liquidized, and an expansion valve or the like for depressurizing the coolant liquidized by this heat discharger for promoting its evaporation. The evaporator of the air conditioner body 209 is connected via pipe, hoses, etc. to the compressor and the expansion valve so that the coolant depressurized by the expansion valve may be evaporated and then returned to the compressor.

In FIGS. 15-20, the lower back wall 213 of the cabin 4 includes an upper horizontal wall 218, an upper vertical wall 219 projecting downward from the front end of the upper horizontal wall 218, a lower horizontal wall 220 projecting forward from the lower end of the upper vertical wall 219, and a lower vertical wall 221 projecting downward form the front end of the lower horizontal wall 220. The lower vertical wall 221 is connected to the bottom wall member 58 of the cabin 4.

The closing member 214 includes a rear wall plate 223, a pair of right/left side wall plates 224 and a bottom wall plate 225. The rear wall plate 223 and the pair of right/left side wall plates 224 are interconnected via a pair of right/left side inclined plates 226, and the bottom wall plate 225 and the pair of right/left side wall plates 224 and interconnected via a pair of right/left bottom inclined plates 227.

The upper front portions of the pair of right/left side wall plates 224 are formed as inclined plate portions 229 inclined to extend forward as approaching the outer side. And, the front ends of the inclined plate portions 229 are fixedly connected by means of e.g. welding, to intermediate portions of the right/left outer side of the upper vertical wall 219. The lower portions of the pair of right/left side wall plates 224 project more forwardly than the inclined plate portions 229, with front ends thereof being fixedly connected, by e.g. welding to the right/left outer ends of the lower vertical wall 211.

At opposed outer ends of the lower vertical wall 211 projecting more outward sideways than the side wall plates 224, there are provided a pair of right/left inserting holes 230 for inserting the pilot hoses in/out of the cabin 4. And, at opened edges of the pair of inserting holes 230, guide cylindrical members 232 are attached respectively, and from the pair of right/left side wall plates 224, a plurality of guide bars 213 for guiding the pilot hoses project to the outside.

Figure 19:
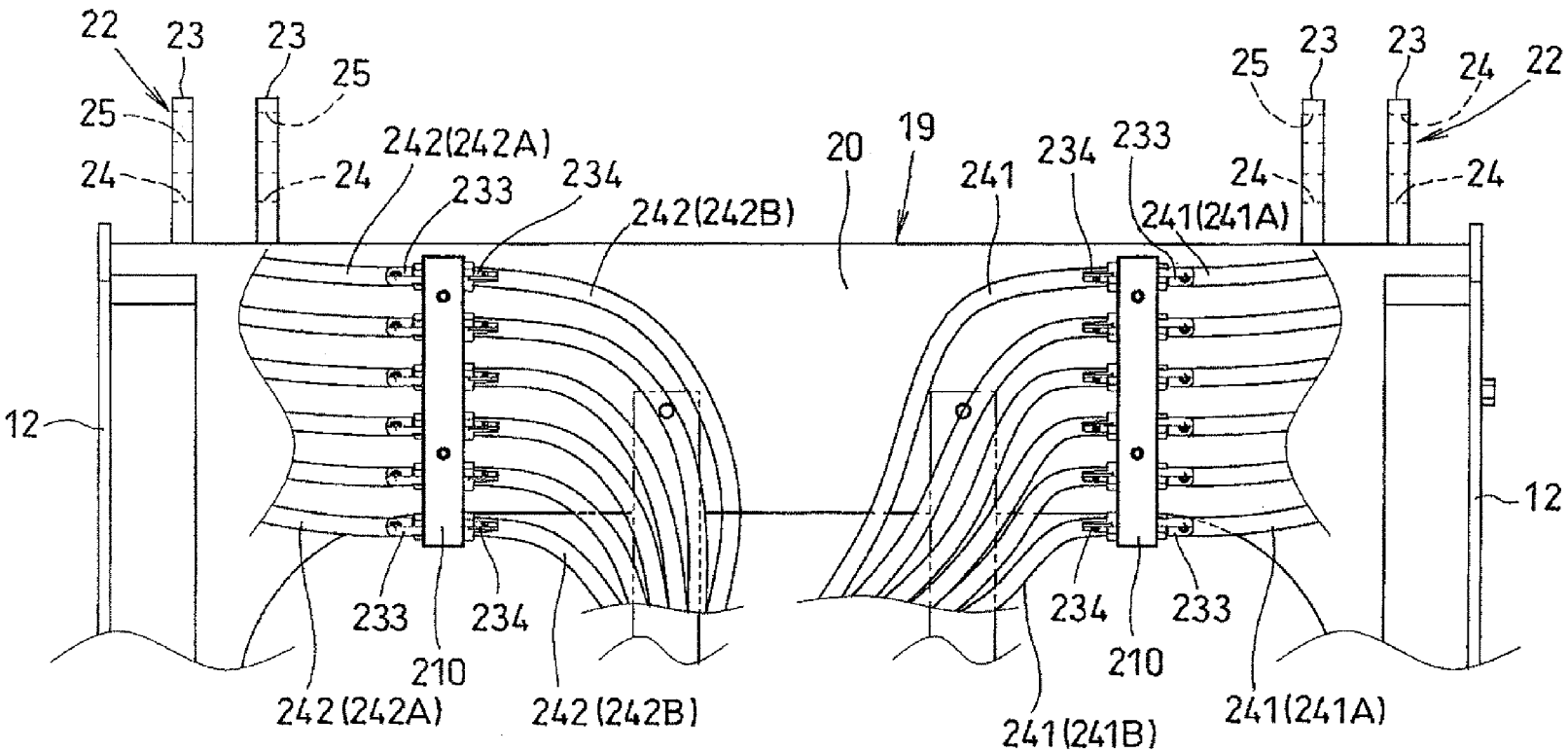
FIG. 19 is a front view showing a transverse connecting member and an relay member.
Figure 20:
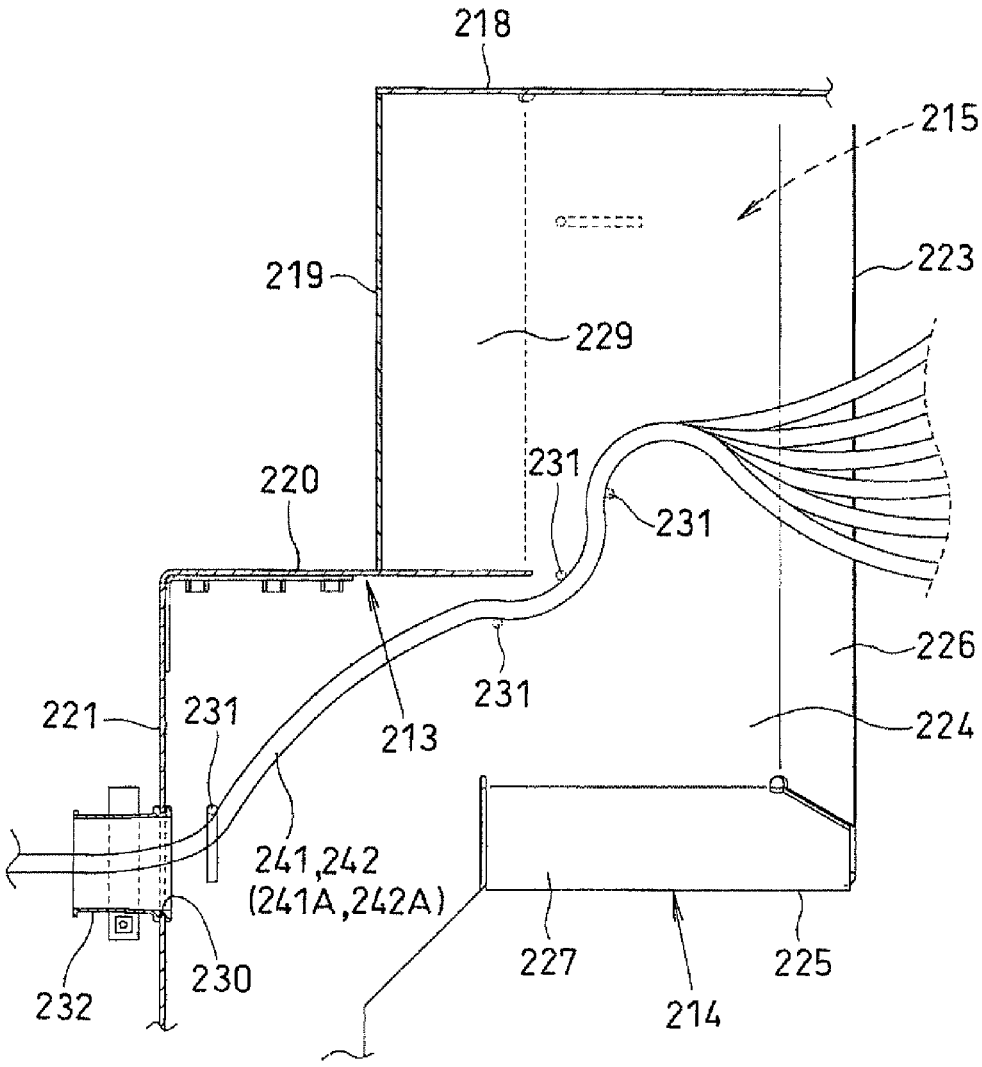
FIG. 20 is a side view in section of a lower back wall portion of the cabin.
Figure 21:
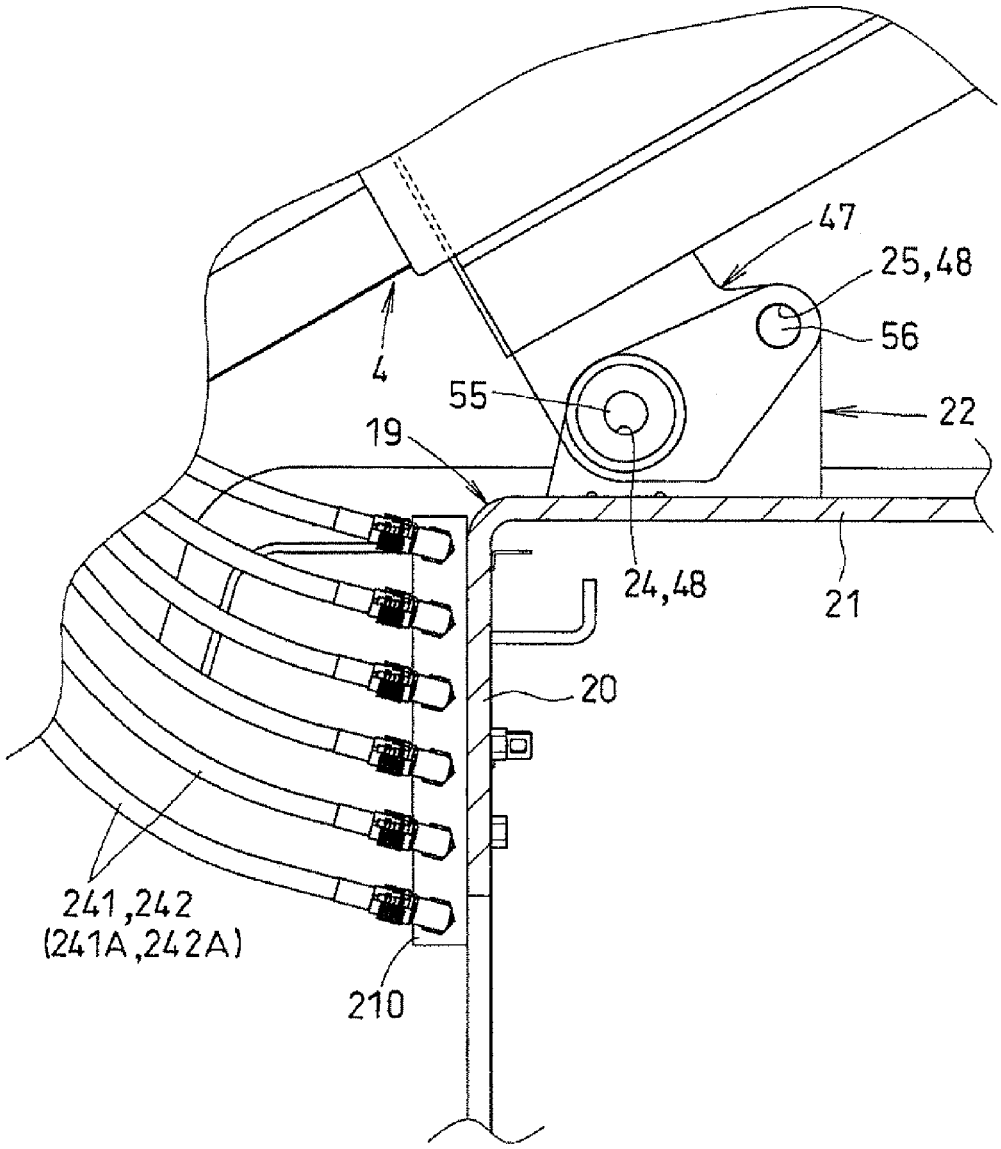
FIG. 21 is a side view in section of the transverse connecting member and the relay member.
Figure 22:
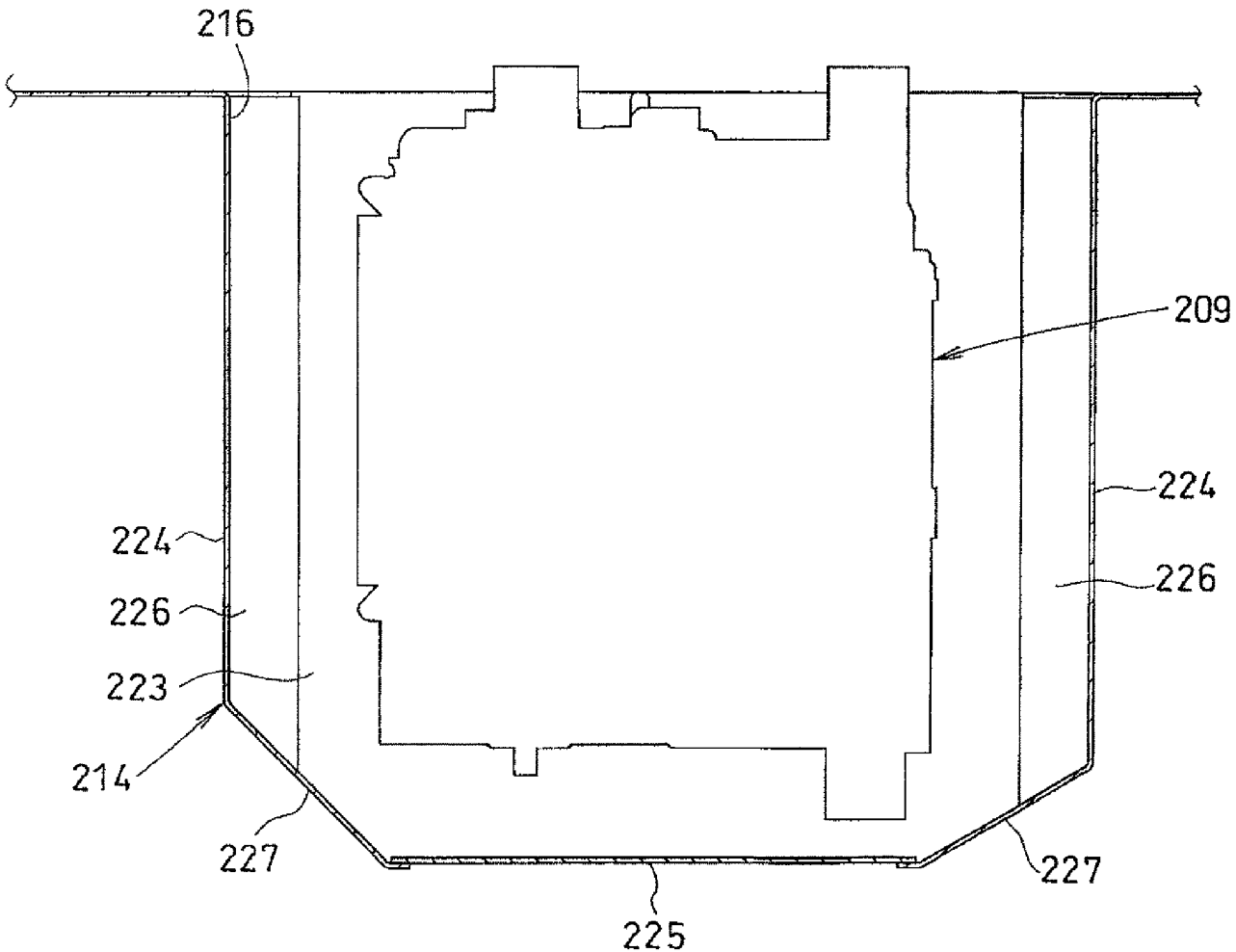
FIG. 22 is a front view in section showing a closing member portion.

As shown in FIG. 19 and FIG. 21, the pilot hose relay members 210 are provided as a pair on the right/left sides, and are attached to the right/left opposed sides of a front wall plate 20 of a transverse connecting member 19 of the machine body frame 1. For the pair of right/left relay members 210, there are provided a plurality of first hose connecting portions 233 projecting to the outer side and a plurality of second hose connecting portions 234 projecting to the inner side, in correspondence therewith. The support shaft 55, acting as the pivot for the cabin 4 as described above, is disposed on the side of the back face of the cabin 4 and located adjacent the relay members 210.

As shown in FIG. 15, inside the cabin 4, there are provided a traveling operational lever 237 for operating the pilot pressure of the traveling hydraulic control device 105, and an implement operational lever 238 for operating the pilot pressure of the implement control valve 207. The traveling operational lever 237 and the implement operational lever 238 are disposed in distribution on the right/left sides of the driver's seat 63 inside the cabin 4, with the traveling operational lever 237 being disposed on the left side of the driver's seat 63, the implement operational lever 238 being disposed on the right side of the driver's seat 63. The traveling operational lever 237 and the implement operational lever 238 are supported to be pivotable back and forth and to the right/left.

Under the traveling control lever 237, a traveling pilot valve is provided and under the implement operational lever 238, a work pilot valve is provided. To the lower portion (traveling pilot valve) of the traveling operational lever 237, there are connected a plurality of traveling pilot hoses 241 and these traveling pilot hoses 241 are disposed with their left sides thereof inside the bottom wall plate 58 of the cabin 4 being oriented rearward. To the lower portion (work pilot valve) of the implement operational lever 238, there are connected plurality of work pilot hoses 242 and these work pilot hoses 242 are disposed with their right sides thereof inside the bottom wall plate 58 of the cabin 4 being oriented rearward.

In FIG. 15, FIG. 19, FIG. 20 and FIG. 21, the plurality of traveling pilot hoses 241 connected to the traveling operational lever 237 and the plurality of work pilot hoses 241 connected to the implement operational lever 238 are drawn from the corresponding inserting holes 230 defined in the lower vertical wall 221 via the guide cylindrical members 322 to the outside of the cabin 4 located on the rear side, and then alternatively hooked vertically or forwardly/rearwardly on the plurality of guide bars 231 and then extended toward the corresponding right/left relay members 210 with some play. With this arrangement, even when the cabin 4 is pivoted about the support shaft 55, it is possible to prevent the pilot hoses 241, 242 from being significantly flexed downward to come into frictional contact with or interfere with other members. Accordingly, damage to these pilot hoses 241, 242 and to other members can be avoided.

Between the traveling operational lever 237 and the traveling hydraulic control device 105, the traveling pilot hoses 241 are connected via the relay member 210 and between the implement operational lever 238 and the implement control valve 207, the plurality of work pilot hoses 242 are connected via the relay member 210. The plurality of traveling pilot hoses 241 and the plurality of work pilot hoses 242 are disposed in distribution on right and left relative to the pair of right/left relay members 210.

Namely, as shown in FIG. 19, the left side relay member 210 is provided as the relay member for the traveling pilot hoses 241 and the right side relay member 210 is provided as the relay member for the work pilot hoses 242. And, the plurality of traveling pilot hoses 241 (the traveling pilot hoses 241A on the cabin 4 side) connected to the traveling operational lever 237 are connected respectively to a plurality of first hose connecting portions 233 of the left side relay member 210. In correspondence therewith, the plurality of traveling pilot hoses 241 (the traveling pilot hoses 241B on the machine body frame 1 side) connected to the traveling hydraulic control device 105 are connected respectively to a plurality of second hose connecting portions 234.

The plurality of pilot hoses 242 (the work pilot hoses 242A on the cabin 4 side) connected to the implement operational lever 238 are connected respectively to a plurality of first hose connecting portions 233 of the right side relay member 210. In correspondence therewith, the plurality of work pilot hoses 242 (the work pilot hoses 242B on the machine body frame 1 side) are connected respectively to a plurality of second hose connecting portions 234 of the right side relay member 210. With the left side traveling operational lever 237 is pivoted forwardly from its neutral position, the traveling hydraulic control device 105 drives forwardly right/left traveling motors 74 to move the track loader forward. When the traveling operational lever 237 is pivoted rearward from the neutral position, the traveling hydraulic control device 105 drives reversely right/left traveling motors 74 to move the track loader rearward.

When the traveling operational lever 237 is pivoted to the left from the neutral position, the traveling hydraulic control device 105 drives reversely the left traveling motor 74 and drives forward the right traveling motor 74, so that the track loader is turned to the left. When the traveling operational lever 237 is pivoted to the right from the neutral position, the traveling hydraulic control device 105 drives forward the left traveling motor 74 and drives reversely the right traveling motor 74, so that the track loader is turned to the right.

When the traveling operational lever 237 is pivoted to the left forward side from the neutral position, the traveling hydraulic control device 105 drives forward or reversely the right/left traveling motors 74, so that the track loader is moved forward with a left-turn corresponding to the pivotal angle of the traveling operational lever 237. When the traveling operational lever 237 is pivoted to the right forward side from the neutral position, the traveling hydraulic control device 105 drives forward or reversely the right/left traveling motors 74, so that the track loader is moved forward with a right-turn corresponding to the pivotal angle of the traveling operational leer 237.

When the traveling operational lever 237 is pivoted to the left rearward side from the neutral position, the traveling hydraulic control device 105 drives forward or reversely the right/left traveling motors 74, so that the track loader is moved reversely with a left-turn corresponding to the pivotal angle of the traveling operational lever 237. When the traveling operational lever 237 is pivoted to the right rearward side from the neutral position, the traveling hydraulic control device 105 drives forward or reversely the right/left traveling motors 74, so that the track loader is moved reversely with a right-turn corresponding to the pivotal angle of the traveling operational lever 237.

When the right side implement operational lever 238 is pivoted forward from its neutral position, the implement control valve 207 causes the boom cylinder 79 to be contracted, thus lowering the boom 77. When the implement operational lever 238 is pivoted rearward from its neutral position, the implement control valve 207 causes the boom cylinder 79 to be expanded, thus elevating the boom 77.

When the implement operational lever 238 is pivoted to the left from the neutral position, the implement control valve 207 cause the bucket cylinder 98 to be contracted, thus causing the bucket 78 to effect a scooping operation. When the implement operational lever 238 is pivoted to the right from the neutral position, the implement control valve 207 cause the bucket cylinder 98 to be expanded, thus causing the bucket 78 to effect a dumping operation.

With the above-described embodiment, as shown in FIG. 14, when the boom cylinder 79 is contracted to lower the boom 77, the upper cylinder support shaft 92 is located forwardly of the second boom support shaft 89 and rearwardly of the second link support shaft 86, and the second link support shaft 86 and the second boom support shaft 89 are located downwardly of the upper cylinder support shaft 92, so that as viewed sideways, the boom cylinder 79 and the second lift link 82 intersect each other in the form of a cross. Therefore, when the boom 77 is lowered, the second lift link 82 supporting the base portion of the boom 77 is located downwardly of the upper end of the boom cylinder 79 so that the base end portion of the boom 77 may be kept low. Further, with this, the rear portion of the machine body frame 1 supporting the base end portion of the boom 77 can be formed low also. For this reason, even if the machine body frame 1 and the cabin 4 are formed low and the driver's seat 63 is set at a low position, the intermediate portion of the boom 77 can be located lower than the view of the driver seated at the driver's seat 63. So, there will hardly occur hindrance of the side view of the driver by the boom 77 and it is also possible to keep the rear portion of the machine body frame 1 not too high as compared with the height position of the driver's seat 63, so the rear visibility too can be improved.

Further, as shown in FIG. 13, when the boom cylinder 79 is expanded to lift up the boom 77, the second boom support shaft 89 is located upwardly of the second link support shaft 86 and the upper cylinder support shaft 92 is located upwardly of the second boom support shaft 89, so that the second boom support shaft 89, the second link support shaft 86 and the upper cylinder support shaft 92 are aligned substantially linearly in the vertical direction. Therefore, even though the base end portion of the boom 77 is disposed at the low position when the boom 77 is lowered as described above, it is possible to lift up the base portion of the boom 77 at as high as possible position when the boom 77 is elevated, so that the leading end of the boom 77 can be lifted up/down significantly on the front side of the machine body frame 1.

Also, there are provided the pair of right/left traveling devices 3 driven by rotation of the drive shafts 71; and the height h2 from the drive shaft 71 to the first link support shaft 85 and the height 133 from the drive shaft 71 to the second link support shaft 86 are set shorter than the height H' from the lower end of the traveling device 3 to the drive shaft 71. Therefore, the machine body frame 1 and the cabin 4 can be formed as low as possible, so that the entire track loader can be compact with low profile.

Since the lower cylinder support shaft 91 is disposed rearwardly and downwardly of the drive shaft 71 of the traveling device 3, the boom cylinder 79 can be disposed at a low position relative to the traveling device 3. So, in this respect too, the machine body frame 1 and the cabin 4 can be formed as low as possible and also the rear portion of the machine body frame 1 can be formed low. Moreover, since the first link support shaft 85 is disposed rearwardly and upwardly of the drive shaft 71 of the traveling device 3, the base end portion of the boom 77 can be lifted up to as high as possible position, when the boom 77 is elevated.

Further, with the above-described embodiment, the ground contacting width B in the fore/aft direction of the pair of right/left traveling device 3, which is the fore-aft width between the centers of the pair of front and rear driven wheels 68, is set to be equal to or greater than a half of the fore/aft width of the machine body frame 1. And, within the fore-aft ground-contacting width B of the pair of right/left traveling devices 3, the drive shaft 71 and the second link support shaft 86 are disposed, and the second link support shaft 86 is disposed forwardly of the drive shaft 71 and with an offset toward the center of the fore/aft ground contacting width B. Therefore, the track loader can travel in stable manner.

When the boom cylinder 79 is expanded to lift up the boom 77, the second boom support shaft 89, together with the second link support shaft 86, is disposed within the fore/aft ground contacting width B of the traveling device 3. Therefore, even under the elevated state of the boom 77, the track loader can be placed in contact with the ground surface in a stable manner and e.g. an excavating operation can be effected smoothly. Further, the lower cylinder support shaft 91 is disposed rearwardly of the traveling device 3; and the upper cylinder support shaft 92 is set at a position within the fore-aft ground contacting width B of the traveling device 3 over the lowered state of the boom 77 with contraction of the boom cylinder 79 and also over the elevated state of the boom 77 with expansion of the boom cylinder 79. And, the cabin 4 is mounted on the machine body frame 1 and the cabin 4 is disposed upwardly of the traveling device 3 and configured such that most part thereof may be located within the fore-aft ground contacting width B of the traveling device 3. Therefore, in this respect too, e.g. stable traveling with the entire track loader being placed in contact with the ground surface in a stable manner is made possible.

Figure 23:
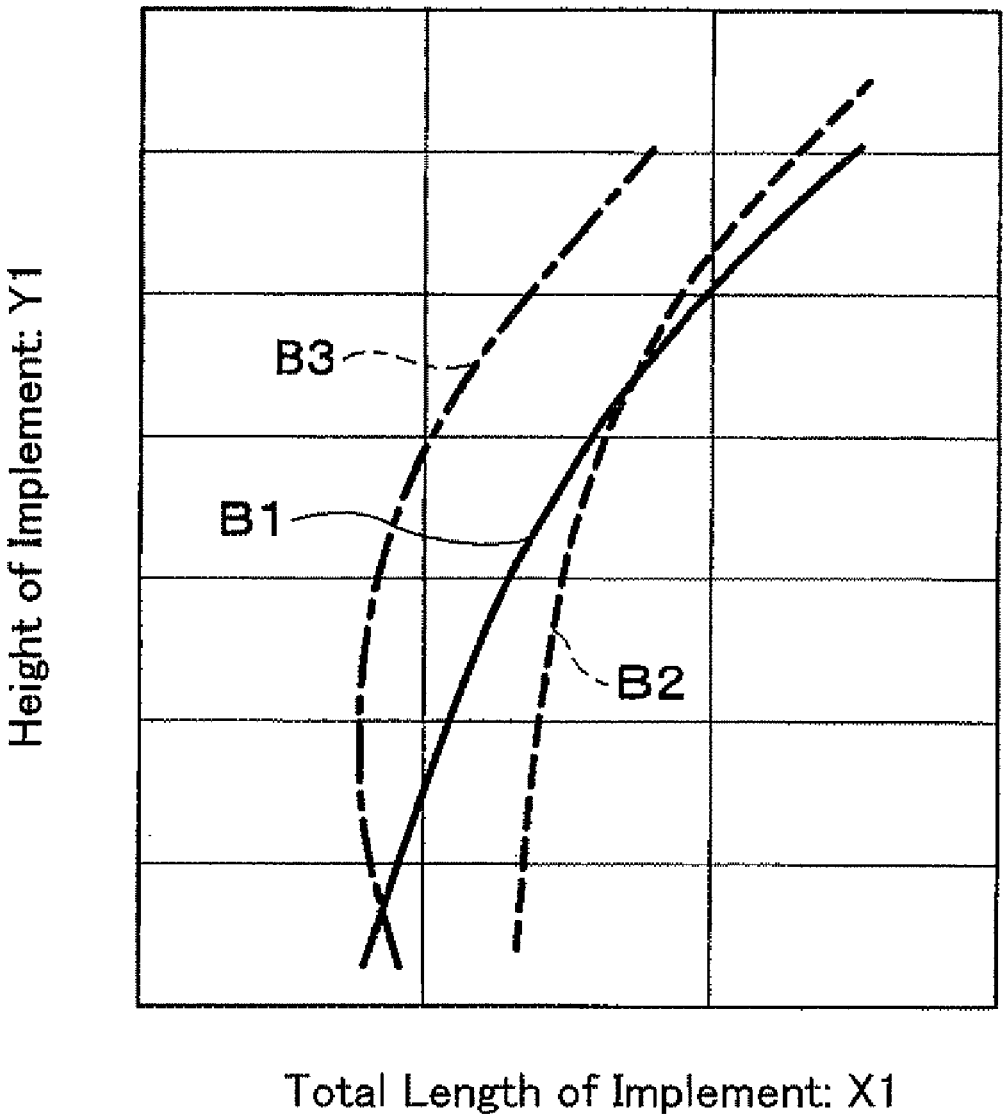
FIG. 23 is a graph illustrating relationship between a height of the leading end of the boom and a length from a first link support shaft to the boom leading end.

FIG. 23 shows a result of simulation effected on relationship between the height of the leading end of the boom (height of implement) Y1 and the length (total length of implement) X1 from the first link support shaft of the first lift link to the leading end of the boom (support shaft 97) when the boom is lifted up/down with contraction/expansion of the boom cylinder, in the case of the embodiment of the present invention, the case of U.S. Pat. No. 7,264,435B2 and the case of U.S. Pat. No. 6,616,398B2.

In the case of the embodiment of the present invention, the relationship between the height of the leading end of the boom 77 (height of the support shaft 97 or height of implement) Y1 and the length (or total length of implement) X1 from the first link support shaft 85 of the first lift link 81 to the leading end of the boom 77 (to the support shaft 97) is as shown by a curve B1 denoted by the solid line in FIG. 23. As shown, as the boom 77 is progressively elevated, there occurs sharp increase in the length X1 from the first link support shaft 85 to the leading end of the boom 77.

On the other hand, in case of the first prior patent, the relationship between the height of the leading end of the boom Y1 and the length X1 from the first link support shaft of the first lift link to the leading end of the boom is as shown by a curve B2 denoted by the broken line in FIG. 23. As shown, as the boom is progressively elevated, there occurs slow increase in the length X1 from the first link support shaft to the leading end of the boom.

Further, in case of the second prior patent, the relationship between the height of the boom cylinder and the length X1 from the first link support shaft of the first lift link to the leading end of the boom is as shown by a curve B3 denoted by the one-dotted line in FIG. 23. As shown, as the boom is progressively elevated, there occurs first slow increase in the length from the first link support shaft of the first lift link to the leading end of the boom, and then the length becomes minimum in the course of the elevation and then occurs increase again with further elevation.

Therefore, as may be understood from FIG. 23, in comparison with the case of U.S. Pat. No. 7,264,435B2 and the case of U.S. Pat. No. 6,616,398B, in the case of the embodiment of the present invention, the rate of increase in the length X1 from the first link support shaft 85 of the first lift link 81 to the leading end of the boom 77 increases and the boom 77 can be elevated to a sufficient height, in spite of the fact that the first link support shaft 85 and the second link support shaft 86 are not located upwardly of the total height of the machine body.

Further, according to the embodiment described above, at the right/left center of the rear face of the cabin 4, there is provided the air conditioner body 209; and on the right/left opposed sides of the air conditioner body 209, there are provided the relay members 210 of pilot hoses. And, these relay members 210 are provided on the side of the machine body frame 1. And, between the operational levers 237, 238 on the side of the cabin 4 and the hydraulic control devices 105, 207 on the side of the machine body frame 1, the pilot hoses 241, 242 are connected via the relay member 210. Therefore, even when the cabin 4 is under the mounted state, it is possible to prevent significant downward pivotal movement of the pilot hoses 241, 242 between the relay members 210 and the hydraulic control devices 105, 207. So that, contact or interference between the pilot hoses 241, 242 and other members can be avoided, whereby it is possible to prevent the pilot hoses 241, 242 and other members from damaging or breaking. Further, as the relay members 210 are attached to the side of the machine body frame 1, even when the cabin 4 is pivoted about the support shaft 55, there will occur no movement of the relay members 210 relative to the machine body frame 1. Hence, clamping and guiding of the pilot hoses 241, 242 to be disposed toward the machine body frame 1 requires only a fewer number of members. Accordingly, the number of assembling steps and the number of components too can be fewer. Moreover, since the air conditioner body 209 can be accommodated with effective utilization of unused space present on the rear face of the cabin 4. And, the relay members 210 too can be disposed with ingenious utilization of the unused spaces present on the right/left sides of the air conditioner body 209. And, the air conditioner body 209 or the relay members 210 does no present any obstacle for the work with or diving of the track loader, advantageously.

Further, as the support shaft 55 serving as the pivot for the cabin 4 is disposed on the rear side of the cabin 4 to be adjacent the relay members 210, even when the cabin 4 is pivoted about the support shaft 55, this pivotal movement of the cabin 4 does not cause significant pivotal movement of the pilot hoses 241, 242. So, in this respect too, the contact or interference between the pilot hoses 241, 242 and other members on the side of the machine body frame 1 can be avoided.

Forwardly into the rear end lower portion of the cabin 4, there is provided the lower back wall 213; and rearwardly of this lower back wall 213, there is provided the closing member 214. Between the lower back wall 213 and the closing member 214 of the cabin 4, the air conditioner accommodating portion 215 is formed and in this air conditioner accommodating portion 215, the air conditioner body 209 is accommodated. With these, the air conditioner body 209 can be retained easily and reliably to the back face of the cabin 4.

Further, the traveling operational lever 237 for operating the pilot pressure of the traveling hydraulic control device 105 and the implement operational lever 238 for operating the pilot pressure of the implement control valve 207 are disposed in distribution on the right/left sides of the driver's seat 63 inside the cabin 4. And, the plurality of traveling pilot hoses 241 for interconnecting the traveling operational lever 237 and the traveling hydraulic control device 105 and the plurality of work pilot hoses 242 for interconnecting the implement operational lever 238 and the implement control valve 207 are disposed in distribution on the right/left sides, relative to the right/left pair of relay members 210. Therefore, the plurality of traveling pilot hoses 241 and the plurality of work pilot hoses 242 can be arranged neatly in distribution on the right/left sides, so as not to cause mutual entanglement or interference between the plurality of traveling pilot hoses 241 and the plurality of work pilot hoses 242.

Incidentally, in the foregoing embodiment, on the side of the machine body frame 1, there are provided the traveling hydraulic control device 105 for controlling driving of the traveling motor 74, and the implement control valves 207 for controlling driving of the boom cylinder 79 and the bucket cylinder 98. And, the traveling operational lever 237 for operating the pilot pressure of the traveling hydraulic control device 105 and the implement operational lever 238 for operating the pilot pressure of the implement control valve 207 are disposed in distribution on the right/left sides inside the cabin 4. Instead of these, only either one of the traveling hydraulic control device 105 and the implement control valve 207 may be provided on the side of the machine body frame 1 and in correspondence therewith, only either one of the traveling operational lever 237 for operating the pilot pressure of the traveling hydraulic control device 105 and the implement operational lever 238 for operating the pilot pressure of the implement control valve 207 maybe provided inside the cabin 4.

INDUSTRIAL APPLICABILITY

The present invention is applicable to loader work machines.

The invention claimed is:

1. A loader work machine comprising:

a machine body frame including a frame body having a bottom wall and a pair or right/left side walls, and a pair of right/left support frame members connected to a rear end of the frame body;

a cabin mounted on the machine body frame;

a transverse connecting member disposed rearwardly of the cabin for connecting the pair of right/left support frame members to right/left sides thereof, respectively;

a pair of fight/left arms disposed on right/left sides of the machine body frame, with base portions thereof being vertically pivotally supported to the pair of right/left support frame members, respectively;

a pair of right/left arm cylinders provided between the base portions of the arms and the rear portions of the machine body frame for lifting up/down the arms; and a hood provided at the rear end of the frame body and downwardly of the transverse connecting member between the pair of right/left support frame members, for housing an engine;

wherein the transverse connecting member includes a front wall plate and an upper wall plate projecting rearward from an upper end of the front wall plate;

the upper wall plate of the transverse connecting member is disposed more downwardly than the vertical center of the cabin;

a rear portion of the upper wall plate is inclined downwardly rearward;

a hood upper wall is provided for covering a rear upper side between the pair of fight/left support frame members;

a front end portion of the hood upper wall is connected to the rear portion of the upper wall plate of the transverse connecting member; and the hood upper wall is inclined downwardly rearward in correspondence with the rear portion of the upper wall plate.

2. The loader work machine according to claim 1, wherein the cabin is pivotally supported to a support bracket projecting from the upper wall plate to be pivotable about a support shaft, the cabin being pivotable between a mounted state where a bottom portion of the cabin is mounted on the machine body frame and a collapsed state where the bottom portion of the cabin is upwardly away from the machine body frame;

the support shaft acting as a pivot for the cabin is disposed on a rear face side of the cabin and substantially at a vertical center of the cabin;

the hood is disposed more downward than the support shaft acting as the pivot for the cabin; and an upper face of the hood is disposed horizontal or downwardly inclined rearward so as not to project more upward than the support shaft.

3. The loader work machine according to claim 1, wherein a height from a lower end of the machine body frame to a rear end of the hood upper wall is set to be ½ or less of a height from the lower end of the machine body frame to an upper end of the cabin.

4. The loader work machine according to claim 1, wherein a lid member is provided at the rear end of the machine body frame for covering a rear end opening between the pair of right/left support frame members; and an upper end portion of the lid member is inclined downwardly rearward in correspondence with the hood upper wall.

5. The loader work machine according to claim 1, wherein the upper wall plate of the transverse connecting member is disposed more upwardly than a seat portion of a driver's seat provided in the cabin and more downwardly than an upper end of a backrest of the driver's seat.

6. The loader work machine according to claim 1, wherein the base portions of the pair of right/left arms are supported to a rear upper portion of the machine body frame via a rearward pair of right/left first lift links and a forward pair of right/left second lift links;

a front connecting member is provided at leading ends of the pair of right/left arms for interconnecting the pair of right/left arms; and a rear connecting member is provided at the base ends of the pair of right/left arms for interconnecting the pair of tight/left arms; and wherein the pair of right/left alms, the front connecting member and the rear connecting member together form a rectangular framework.

7. The loader work machine according to claim 6, wherein a lower base portion of the first lift link is pivotally supported to the machine body frame by a first lift support shaft;

a base portion of the second lift link is pivotally supported to the machine body frame by a second lift support shaft, forwardly of the first link support shaft;

a base portion of the arm is pivotally supported to an upper free end of the first lift link by a first arm support shaft;

a base portion of the arm is pivotally supported to a free end portion of the second lift link by a second arm support shaft, forwardly of the first arm support shaft;

a lower base end of the arm cylinder is pivotally connected to the machine body frame by a lower cylinder support shaft;

an upper leading end portion of the arm cylinder is pivotally connected to the base portion of the arm by an upper cylinder support shaft; and the rear connecting member is disposed forwardly of the first arm support shaft of the base portion of the arm.

8. The loader work machine according to claim 7, wherein the rear connecting member is disposed on a connecting line interconnecting the first arm support shaft and the upper cylinder support shaft, at the base portions of the pair of right/left arms.

9. The loader work machine according to claim 7, wherein the rear connecting member is disposed closer to the first arm support shaft than the upper cylinder support shaft.

10. The loader work machine according to claim 7, wherein when the arm cylinder is contracted to lower the arm, the rear connecting member is located downwardly of the first arm support shaft; and when the arm cylinder is expanded to raise the arm, the rear connecting member is located upwardly of the first arm support shaft.

11. The loader work machine according to claim 7, wherein the upper cylinder support shaft is disposed such that: when the arm cylinder is contracted to lower the arm, the upper cylinder support shaft is located downwardly of the rear connecting member; and when the aim cylinder is expanded to raise the arm, the upper cylinder support shaft is located upwardly of the rear connecting member.

12. The loader work machine according to claim 6, wherein a holding member is provided for holding the hood upper wall under an opened posture; and the rear connecting member is disposed at a position upwardly away from the hood upper wall so that the hood upper wall can be held under the opened posture by the holding member when the arm cylinder is contracted to lower the arm.

13. The loader work machine according to claim 6, wherein the base portion of the arm includes an outer wall and an inner wall;

an extension attaching wall extends from the inner wall at the base portion of the arm, and projects more downwardly than a lower edge of the outer wall;

an inner bracket is provided at a right/left inner side of the extension attaching wall and in opposition to the extension attaching wall;

an upper free end of the first lift link and an upper leading end of the arm cylinder are pivotally connected between the inner wall and the outer wall of the base portion of the arm; and a free end of the second lift link is pivotally connected between the extension attaching wall and the inner bracket.

14. The loader work machine according to claim 13, wherein the second lift link is disposed on the inner side in the right/left direction than the arm cylinder so that the arm cylinder and the second lift link may cross each other as viewed sideways;

the upper free end of the first lift link is pivotally connected by the first arm support shaft, rearwardly of the extension attaching wall;

the upper leading end of the aim cylinder is pivotally connected to the upper cylinder support shaft, forwardly of the extension attaching wall; and the free end of the second lift link is pivotally connected by the second arm support shaft, more downwardly than a segment interconnecting the first arm support shaft and the upper cylinder support shaft.

15. The loader work machine according to claim 13, wherein the base portion of the arm includes an upper connecting wall extending along upper edges of the inner wall and the outer wall, and a lower connecting wall extending along lower edges of the inner wall and the outer wall;

the inner wall and the outer wall of the base portion of the arm are interconnected by the upper connecting wall and the lower connecting wall;

the inner bracket is connected to an inner face of the extension attaching wall or an inner face of the inner wall, by a bracket connecting wall extending along an upper edge of the inner bracket; and an intermediate portion of the bracket connecting wall projects more upwardly than the lower connecting wall so that the bracket connecting wall may intersect the lower connecting wall as viewed sideways.

16. The loader work machine according to claim 13, wherein a second arm support shaft provided on the free end side of the second lift link, and a second link support shaft are visible from outside the machine body frame.

* * * * *

UNITED STATES PATENT AND TRADEMARK OFFICE

CERTIFICATE OF CORRECTION

PATENT NO. : 8,342,789 B2
APPLICATION NO. : 12/531789
DATED : January 1, 2013
INVENTOR(S) : Toyoaki Yasuda et al.

It is certified that error appears in the above-identified patent and that said Letters Patent is hereby corrected as shown below:

Column 29, Line 40, Claim 1, delete "fight/left" and insert -- right/left --

Column 29, Line 61, Claim 1, delete "fight/left" and insert -- right/left --

Column 30, Line 44, Claim 6, delete "tight/left" and insert -- right/left --

Column 30, Line 45, Claim 6, delete "alms" and insert -- arms --

Column 31, Line 19, Claim 11, delete "aim" and insert -- arm --

Column 32, Line 13, Claim 14, delete "aim" and insert -- arm --

Signed and Sealed this
Fifth Day of March, 2013

Teresa Stanek Rea

Teresa Stanek Rea
*Acting Director of the United States Patent and Trademark Office*